US006422502B1

(12) United States Patent
Takada et al.

(10) Patent No.: US 6,422,502 B1
(45) Date of Patent: Jul. 23, 2002

(54) WINDING UNIT

(75) Inventors: Seiichi Takada; Atsushi Yoshioka, both of Mie (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 09/789,798

(22) Filed: Feb. 22, 2001

(30) Foreign Application Priority Data

Feb. 24, 2000 (JP) ..... 2000-047843
Jul. 19, 2000 (JP) ..... 2000-219430

(51) Int. Cl.[7] ..... B65H 18/12
(52) U.S. Cl. ..... 242/543; 242/545; 242/545.1
(58) Field of Search ..... 242/543, 545, 242/545.1, 546.1, 422.4

(56) References Cited

U.S. PATENT DOCUMENTS 2,827,245 A * 3/1958 Kleinschmidt et al. ..... 242/543
2,845,232 A * 7/1958 Johnson et al. ..... 242/545
5,273,229 A * 12/1993 Komatsu ..... 242/545.1
5,328,116 A * 7/1994 Hishinuma ..... 242/543
6,113,021 A * 9/2000 Hosokawa ..... 242/545.1

* cited by examiner

*Primary Examiner*—John M. Jillions
(74) *Attorney, Agent, or Firm*—Wenderoth, Lind & Ponack, L.L.P.

(57) ABSTRACT

A winding unit is provided in which one-way clutches for driving and braking are mounted in the inner surface of the reel and a web such as a cover tape 39 is wound by intermittently rotating the reel. Tension acting on the web can be released during replacement of the reel. A spring type torque limiter 18 is disposed between the reel boss 25 and outer rings 12, 12' of the one-way clutches 9, 11 for driving and braking. The torque limiter 18 is arranged such that, during rotation in the winding direction, a coil spring 27 locks to transmit torque, and when the reel is forcibly turned in the unwinding direction, slip occurs, thus releasing the tension in the web.

12 Claims, 28 Drawing Sheets

WINDING UNIT

BACKGROUND OF THE INVENTION

This invention relates to a winding unit for intermittently winding a web such as a tape.

This type of winding unit is used to wind a web fed from an intermittently operating processing stage in synchronization with the operating pitch of the processing stage. For example, it is used to wind a cover tape (also called top tape) which has transported electronic parts such as semiconductor chips in pockets of the tape, or to take up a cleaner sheet used to clean the fixing unit of a copier or a printer.

FIGS. 24 and 25 show a winding unit used to wind a cover tape 60 after it has transported semiconductors. A reel 61 of the winding unit includes a support reel 62 having a reel boss portion 62' and a detachable reel 78 mounted on the reel boss portion 62' so as to be not rotatable relative to the reel boss portion. The cover tape 60 is wound around the detachable reel 78. This winding unit has a one-way clutch 63 for driving and a one-way clutch 64 for braking mounted in an inner peripheral surface of a reel boss portion 62'. The one-way clutch 63 for driving is mounted on a stepped fixed shaft 67 through a rotary sleeve 66 having a pivoting lever 65, while the one-way clutch 64 for braking is directly mounted on the fixed shaft 67.

The fixed shaft 67 is fixed by a bolts 69 to a bracket 68, which is fixed to a base 79 (FIG. 24) by bolts 80. Thus the rotary sleeve 66 is prevented from coming off the shaft 67 by the bracket 68.

The pivoting lever 65 is intermittently pivoted by a predetermined angle (shown by arrow A in FIG. 24) in synchronization with the pitch of supply of semiconductor chips. At this time, the one-way clutch 63 for driving locks the reel boss portion 62' and the rotary sleeve 66 together, and the support reel 62 rotates a predetermined angle together with the rotary sleeve 66 to wind the cover tape 60 around the reel 61. When a predetermined length of cover tape 60 has been wound, the pivoting lever 65 is returned to the original position by a coil spring 70. At this time, the one-way clutch 64 for braking locks the reel boss portion 62' and the fixed shaft, 67 together, so that only the pivoting lever 65 and the rotary sleeve 66 return to the original positions.

The one-way clutches 63 and 64 have on the inner peripheral surfaces of their outer rings 71 and 72 a plurality of cam surfaces inclined in the circumferential direction. At positions opposite to the respective cam surfaces, rollers 73 and 74 are mounted. The rollers 73 and 74 are biased by springs 75 and 76, respectively, in such directions that they are locked by the cam surfaces. The one-way clutches 63 and 64 are axially separated from each other by a shoulder 77 formed on the inner peripheral surface of the reel boss portion 62' so as not to interfere with each other.

With this winding unit, when the reel 61 becomes full of the wound cover tape 60, it is necessary to dismount the detachable reel 78 from the support reel 62 for replacement.

But since the support reel 62 is braked by the one-way clutch 63 for braking and cannot turn in reverse, tension during winding still acts on the cover tape 60. This makes it difficult to dismount the detachable reel 78.

An object of this invention is to provide a winding unit in which during replacement of the reel 78, the reel can be rotated in reverse direction so that the tension in the cover tape 60 can be released.

SUMMARY OF THE INVENTION

According to this invention, there is provided a winding unit for winding a web, the winding unit comprising a fixed shaft, a rotary sleeve having a lever and rotatably mounted on the fixed shaft, a support reel having a reel boss portion, a reel detachably mounted on the reel boss portion, a one-way clutch for driving and a one-way clutch for braking each having an outer ring formed with a plurality of circumferentially inclined cam surfaces on an inner peripheral surface thereof, rolling elements mounted at positions opposing the respective cam surfaces, and springs for biasing the rolling elements in such directions as to be locked by the cam surfaces, the one-way clutches being mounted in the reel boss portion, the one-way clutch for driving being mounted on the fixed shaft through the rotary sleeve, the one-way clutch for braking being mounted on the fixed shaft, the reel being intermittently rotated by pivoting the pivoting lever to wind the web on the reel, a torque limiter being provided between the outer ring and the reel boss portion to shut off transmission to the outer ring of a turning torque in the unwinding direction applied to the reel boss portion.

With this arrangement, either during the intermittent web winding periods or during intermittent rest periods, the torque limiter assures winding without producing any slip, and the web maintains a constant tension due to the function of the one-way clutch for braking. When necessity of releasing the tension in the web arises e.g. during replacement of the reel, by forcibly turning the reel in the unwinding direction, the reel will turn while slipping relative to the outer ring to release the tension in the web.

More specifically the torque limiter is set so as to have a sufficiently large winding torque value for the transmission of torque in the winding direction from the outer ring to the reel boss portion and to have a predetermined unwinding torque value for the transmission of a torque in the unwinding direction from the reel boss portion to the outer ring. When the reel boss portion is forcibly turned with a torque exceeding such an unwinding torque value, slip occurs.

As a further specific structure, the torque limiter is a spring type torque limiter comprising a torque limiter ring mounted on an outer peripheral surface of the outer ring, and a coil spring mounted on an outer peripheral surface of the torque limiter ring with a predetermined binding force, the coil spring has one end thereof engaging the reel boss portion, the coil spring being adapted to lock when the torque limiter ring rotates in the winding direction so that the binding force increases, and to have a predetermined unwinding torque value when the reel boss portion rotates in the unwinding direction so that the binding force decreases.

A restraining means for the coil spring may be provided on the reel boss portion to prevent one end of the coil spring from moving in the circumferential direction. With this arrangement, when winding around the reel is performed by pivoting the pivoting lever, movement of the coil spring relative to the reel boss portion is prevented by the restraining means, so that the pivoting angles of the pivoting lever and the reel coincide with each other.

The coil spring may have the other end thereof engaging a lid member fitted in the end of the torque limiter ring.

The torque limiter may be a press-in type torque limiter in which the torque limiter ring is pressed in the reel boss portion.

Also, there is provided a structure wherein the torque limiter is a cam type torque limiter comprising a torque limiter ring pressed in the reel boss portion, cam recesses formed in one of the torque limiter ring and the reel boss portion, rolling elements housed in pockets formed in the other thereof so as to oppose the cam recesses, and resilient members each housed in the respective pocket for biasing the rolling elements toward the cam recesses.

As a further specific structure of the cam type torque limiter, there is also provided a structure wherein the torque limiter ring has a rolling element retaining portion on a radially outer side thereof and a resilient member retaining portion on a radially inner side thereof, the rolling element retaining portion being formed with a plurality of pockets at angular spacings so as to radially extend therethrough, the rolling elements being housed in the respective pockets and biased from a single resilient member housed in the resilient member retaining portion. With this arrangement, since the resilient members are formed of a single member, the number of parts decreases.

DETAILED DESCRIPTION OF THE PREFERRED EMBODIMENT

Figure 1:
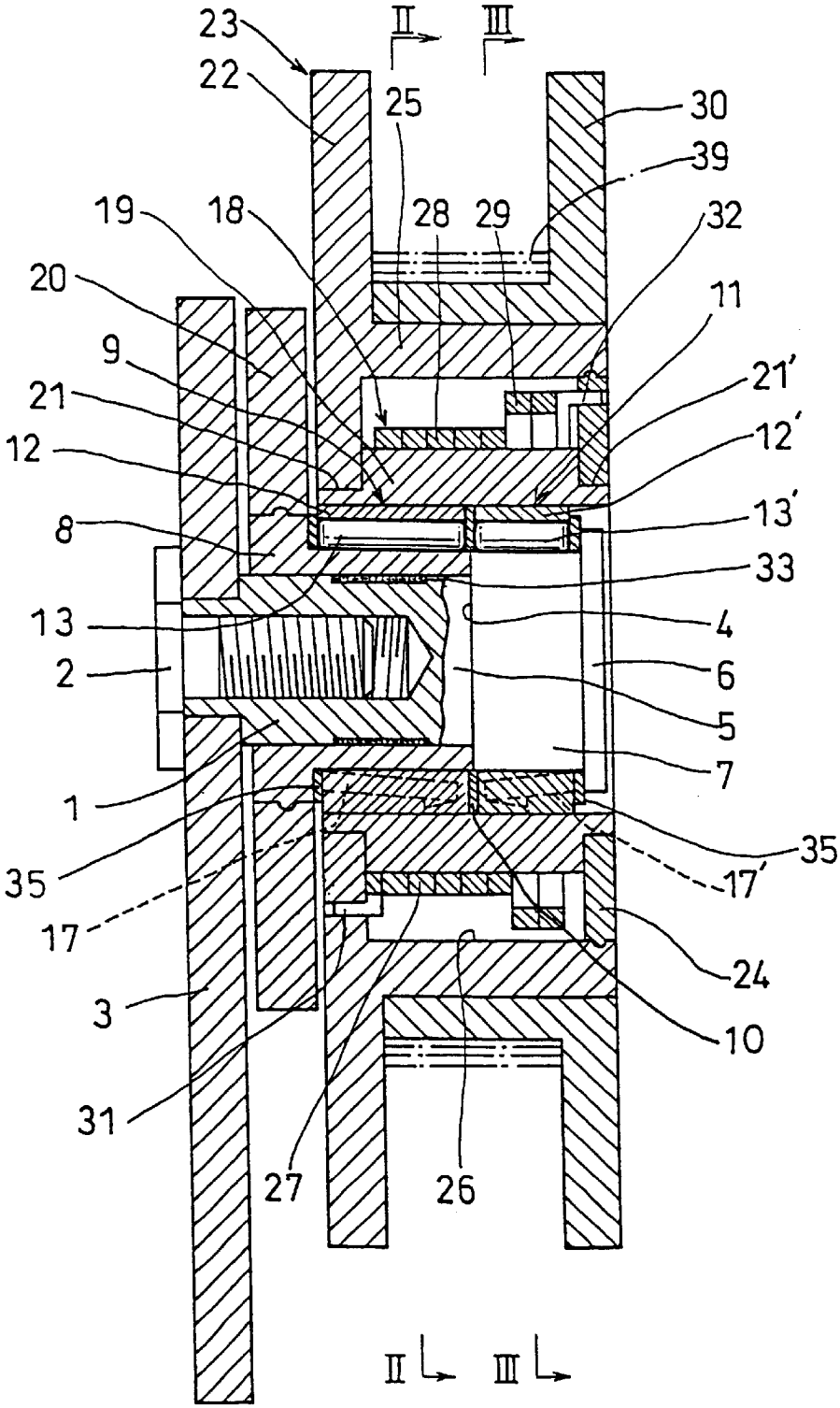
FIG. 1 is a sectional view of a first embodiment.

Hereinbelow, the embodiments of this invention will be described with reference to the attached drawings. The winding unit of the first embodiment shown in FIGS. 1–4 has a fixed shaft 1 fixed to a bracket 3 by a bolt 2. The fixed shaft 1 has a shoulder 4 at its intermediate portion. The portion between the bracket 3 and the shoulder 4 is a small-diameter portion 5, while the portion between the shoulder 4 and a flange 6 at the tip is a large-diameter portion 7. A flanged rotary sleeve 8 is rotatably mounted on the small-diameter portion 5. It has the same diameter as the large-diameter portion 7.

A one-way clutch 9 for driving is fitted on the rotary sleeve 8. A one-way clutch 11 for braking is fitted on the large-diameter portion 7 of the fixed shaft 1.

Figure 2:
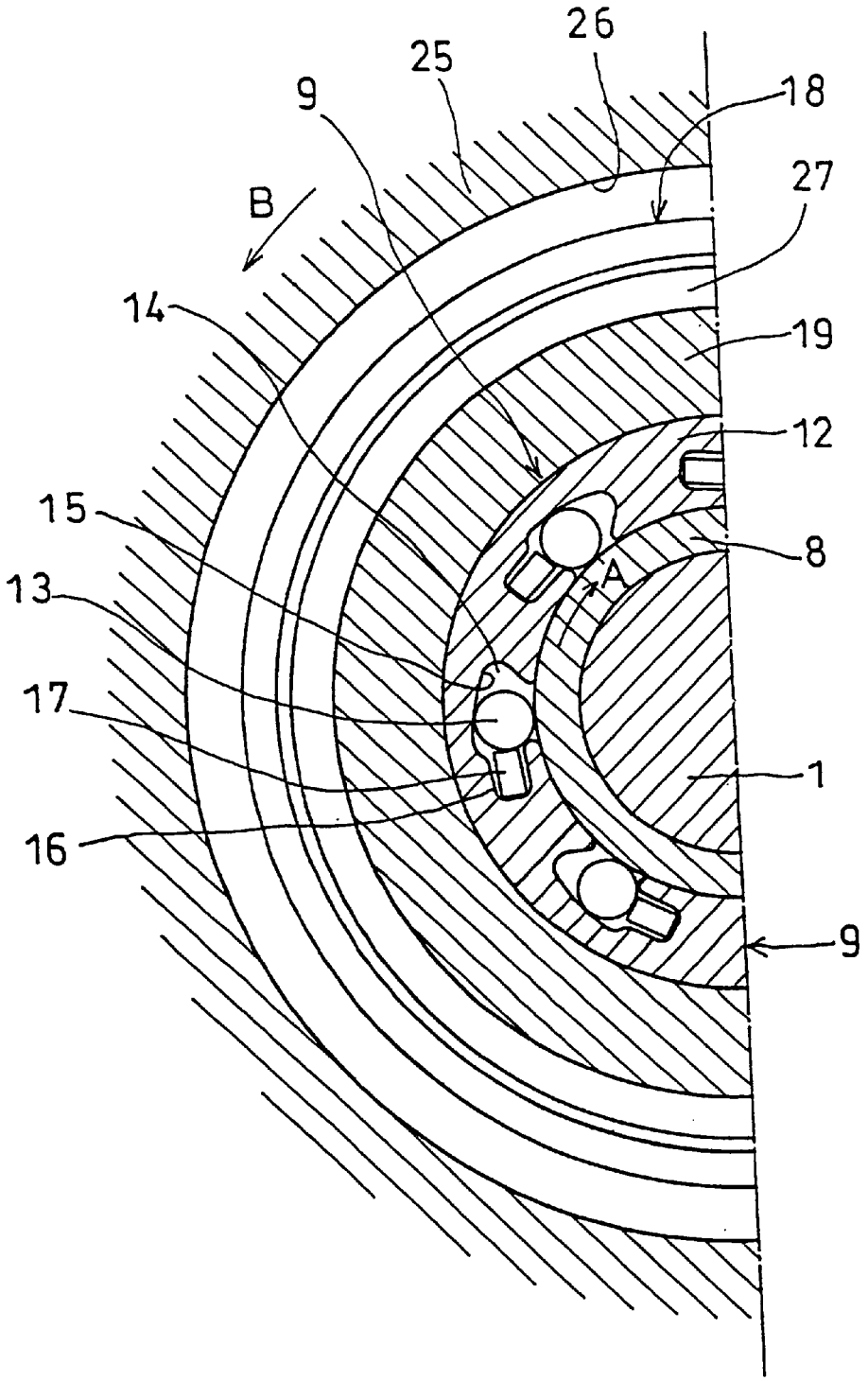
FIG. 2 is a sectional view along line II—II of FIG. 1.
Figure 3:
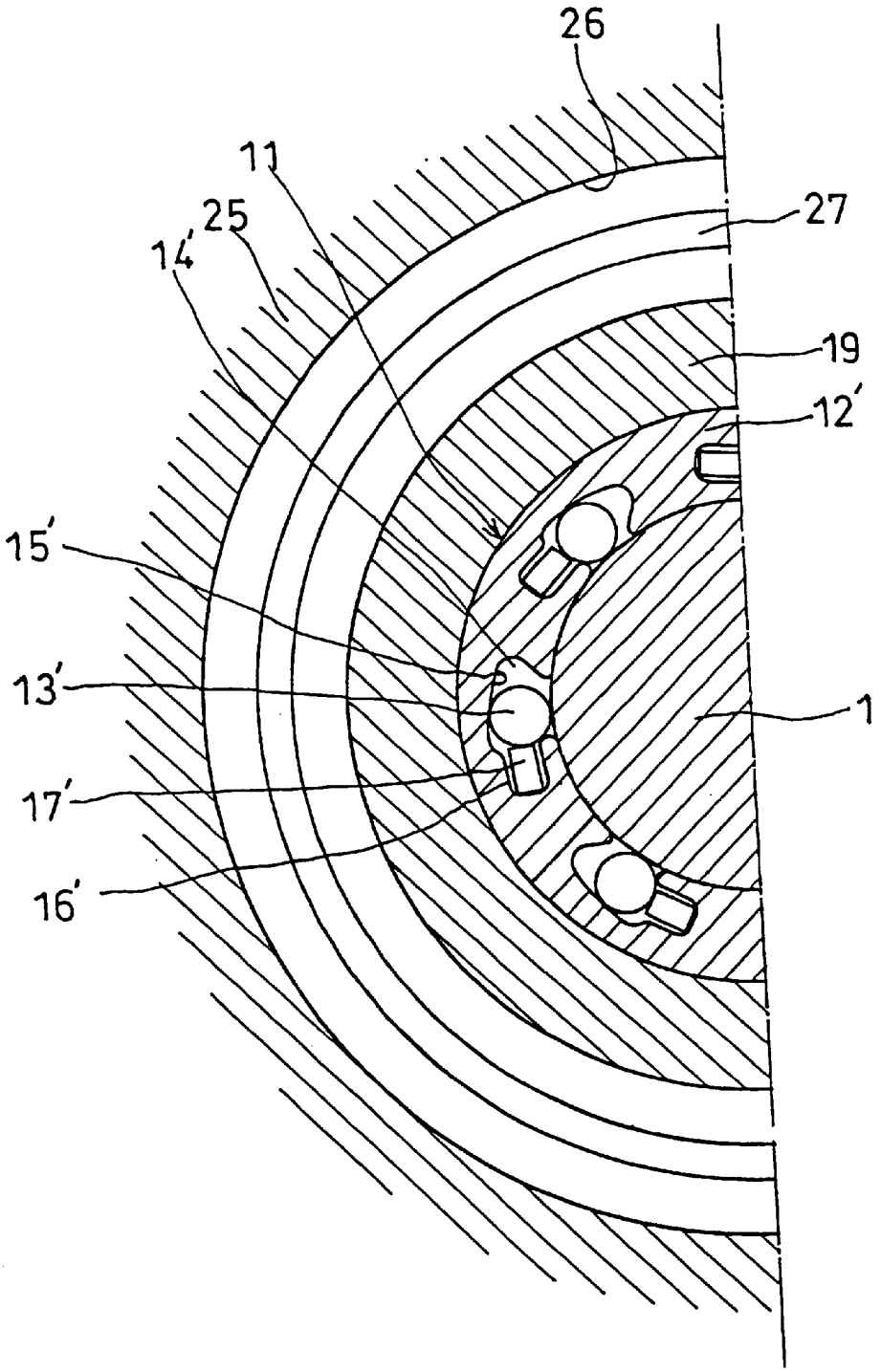
FIG. 3 is a sectional view along line III—III of FIG. 1.

The one-way clutch 9 for driving comprises an outer ring 12 and rollers 13 as rolling elements. In the inner peripheral surface of the outer ring 12, pockets 14 are formed at circumferentially regular intervals as shown in FIG. 2. An inclined cam surface 15 is formed on the bottom of each pocket 14. Wedge-shaped spaces narrowing in the rotational direction of the rotary sleeve 8 during winding (shown by arrow A) are defined by and between the cam surfaces 15 and an outer peripheral surface of the rotary sleeve 8 that opposes the cam surfaces. The rollers 13 are inserted in the wedge-shaped spaces. Recesses 16 are formed at the wide-side ends of the wedge-shaped spaces. A spring 17 received in each recess 16 has one end thereof pressed against the roller 13 to bias it toward the narrow side of the wedge-shaped space, i.e. in the locking direction.

Since the one-way clutch 11 for braking is substantially of the same structure except that the axial width is slightly smaller than that of the one-way clutch 9 for driving, the same parts are denoted by the same numerals with a prime mark added (FIG. 3), and their description is omitted.

A washer 10 is disposed between the outer rings 12 and 12' and between the rollers 13 and 13' of the one-way clutches 9 and 11 to prevent interference with each other. The outer rings 12 and 12' are formed so as to have the same outer diameter. A torque limiter ring 19 which forms a part of a torque limiter 18 is fitted and fixed on the outer rings 12, 12' (FIG. 1). A reel 23 comprises a support reel 22, which has its inner end rotatably mounted in a countersunk portion 21 formed at the inner end of the torque limiter ring 19. An annular lid member 24 is fitted in a countersunk portion 21' formed at its outer end with a predetermined fitting resistance. Instead of providing the washer 10, a rib may be provided on the inner peripheral surface of the torque limiter ring 19 to prevent interference between the outer rings 12 and 12' and between the rollers 13 and 13'. This is true with other embodiments, too.

Between the reel 23 and the bracket 3, a pivoting lever 20 is fixed to the flange portion of the rotary sleeve 8.

The support reel 22 has a reel boss portion 25. A detachable reel 30 having an L section is mounted on the reel boss portion 25 so as to be axially detachable but not to rotate relative to the support reel 22. A spring-housing space 26 is formed between the reel boss portion 25 and the torque limiter ring 19. A coil spring 27 of the torque limiter 18 is housed in the space 26. The coil spring 27 has a small-diameter portion 28 and a large-diameter portion 29. The former is wound around the outer surface of the torque limiter ring 19 with a predetermined binding force. A hook 31 provided at one end of the small-diameter portion 28 is in engagement with the support reel 22. A hook 32 provided at one end of the large-diameter portion 29 is in engagement with the lid member 24.

When the pivoting lever 20 is turned in the winding direction so that the sleeve 8 will rotate in the direction shown by arrow A in FIG. 2, a force in the diameter-reducing direction acts on the small-diameter portion 28 of the coil spring 27, so that the binding force increases, thus locking it. Thus the torque in the winding direction is set at an extremely large value.

On the other hand, when the support reel 22 is turned in the unwinding direction (shown by arrow B of FIG. 2), a force in the diameter-increasing direction acts on the small-diameter portion 28, so that the binding force decreases. That is to say, the torque in the unwinding direction is set at a predetermined level smaller than the torque in the winding direction. But this torque is set larger than the torque in the unwinding direction produced only by the tension of the web acting on the reel 23.

In FIG. 1, 33 is a grease reservoir.

Next, the operation of the winding unit of the first embodiment will be described.

Figure 4:
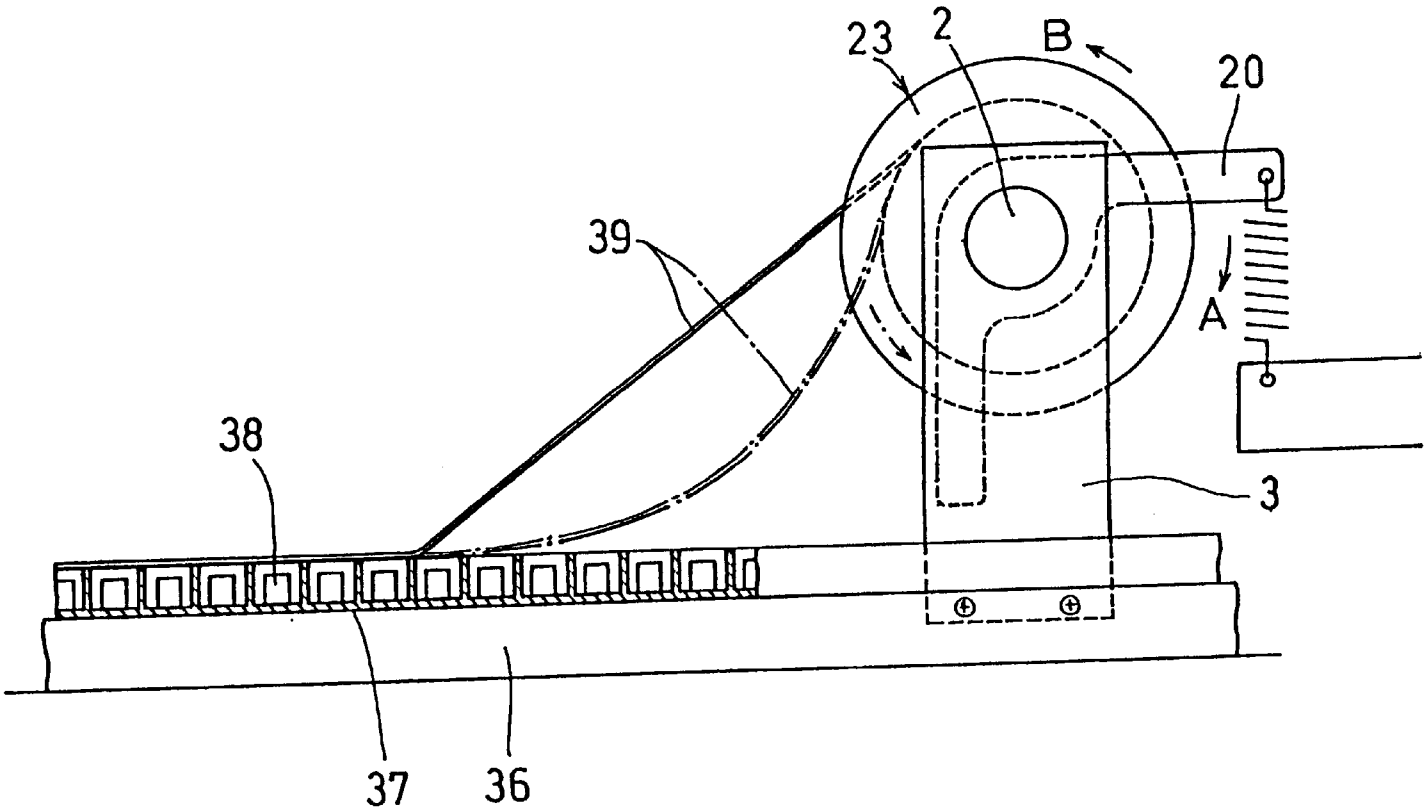
FIG. 4 is a side view of the same in use.

FIG. 4 shows one example of its use and how a cover tape 39 is wound around the reel 23 of the winding unit while semiconductor chips 38 are transported on a transporting tape 37 laid on a base 36.

When the pivoting lever 20 is pivoted a predetermined angle in the winding direction (shown by arrow A of FIG. 4), the rotary sleeve 8 rotates in the winding direction (shown by arrow A of FIG. 2), thus locking the one-way clutch 9 for driving to transmit torque through its outer ring 12 to the torque limiter ring 19. As described above, since the torque limiter 18 has its torque in the winding direction set at an extremely large value while the winding torque of the reel 23 is not so large, the torque limiter 18 transmits torque without producing slip. Thus, a web 39 is wound around the reel 23.

When the pivoting lever 20 is pivoted in the opposite direction, the one-way clutch 11 for braking will operate to put the reel 23 into a rest period. But since the one-way clutch 9 for driving is released from locking, the rotary sleeve 8 will freely rotate to return to the original state.

On the other hand, during the rest period, the reel 23 is subjected to a torque in the unwinding direction (shown by arrow B of FIG. 2) due to the tension of the cover tape 39 wound around the reel 23. But as described above, since the torque in the unwinding direction of the torque limiter 18 is set large compared with the torque in the unwinding direction only by the tension of the tape acting on the reel 23, slip will not occur. Thus, the tension in the tape 39; wound around the reel 23 is kept constant.

By repeatedly pivoting the lever 20 as described above, the reel 23 intermittently winds the cover tape 39. When the detachable reel 30 becomes full and has to be replaced, it is necessary to release tension in the tape 39 wound around the reel 30. For this purpose, the reel 23 is rotated forcibly in the unwinding direction by a hand of an operator. When the turning torque exceeds the torque in the unwinding direction of the torque limiter 18, slip occurs, so that the reel 23 will rotate in a reverse direction and the cover tape 39 will slacken (see the one-dot chain line of FIG. 4).

Adjustment or change of the torque of the torque limiter 18 is carried out by pivoting the lid member 24 to change the binding force of the small-diameter portion 28 of the coil spring 27 through its large-diameter portion 29.

Figure 5:
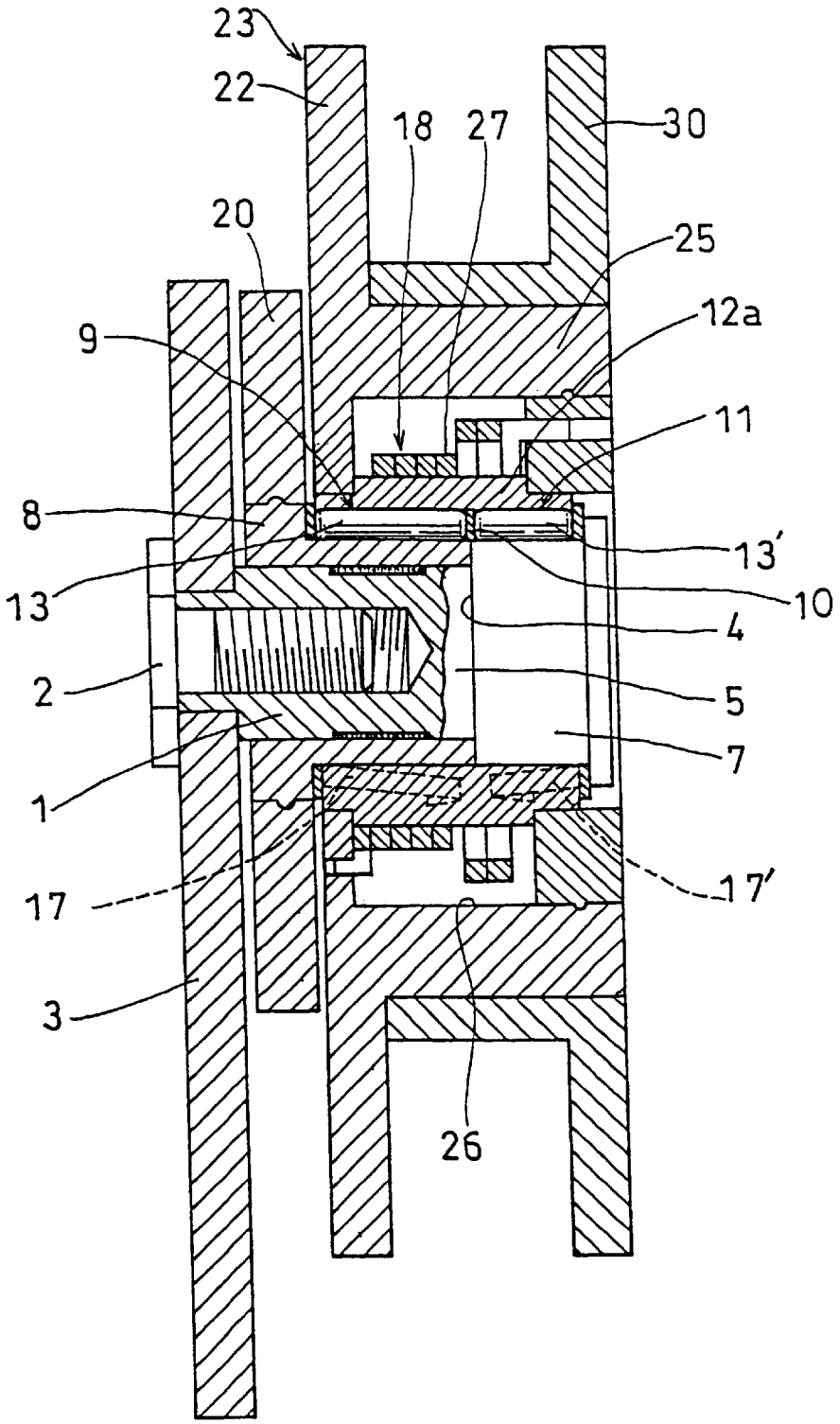
FIG. 5 is a sectional view of a second embodiment.

In the second embodiment shown in FIG. 5, the outer rings 12 and 12' of the one-way clutches 9 and 11 for driving and braking and the torque limiter ring 19 of the torque limiter 18 in the first embodiment are combined together into an outer ring 12*a* so that the functions of these members can be performed by the outer ring 12*a* only.

With this arrangement, although the operation as the winding unit is the same as in the first embodiment, it is possible to reduce the number of parts and to unite the one-way clutches 9 and 11, torque limiter 18 and support reel 22 into units during assembling.

Figure 6:
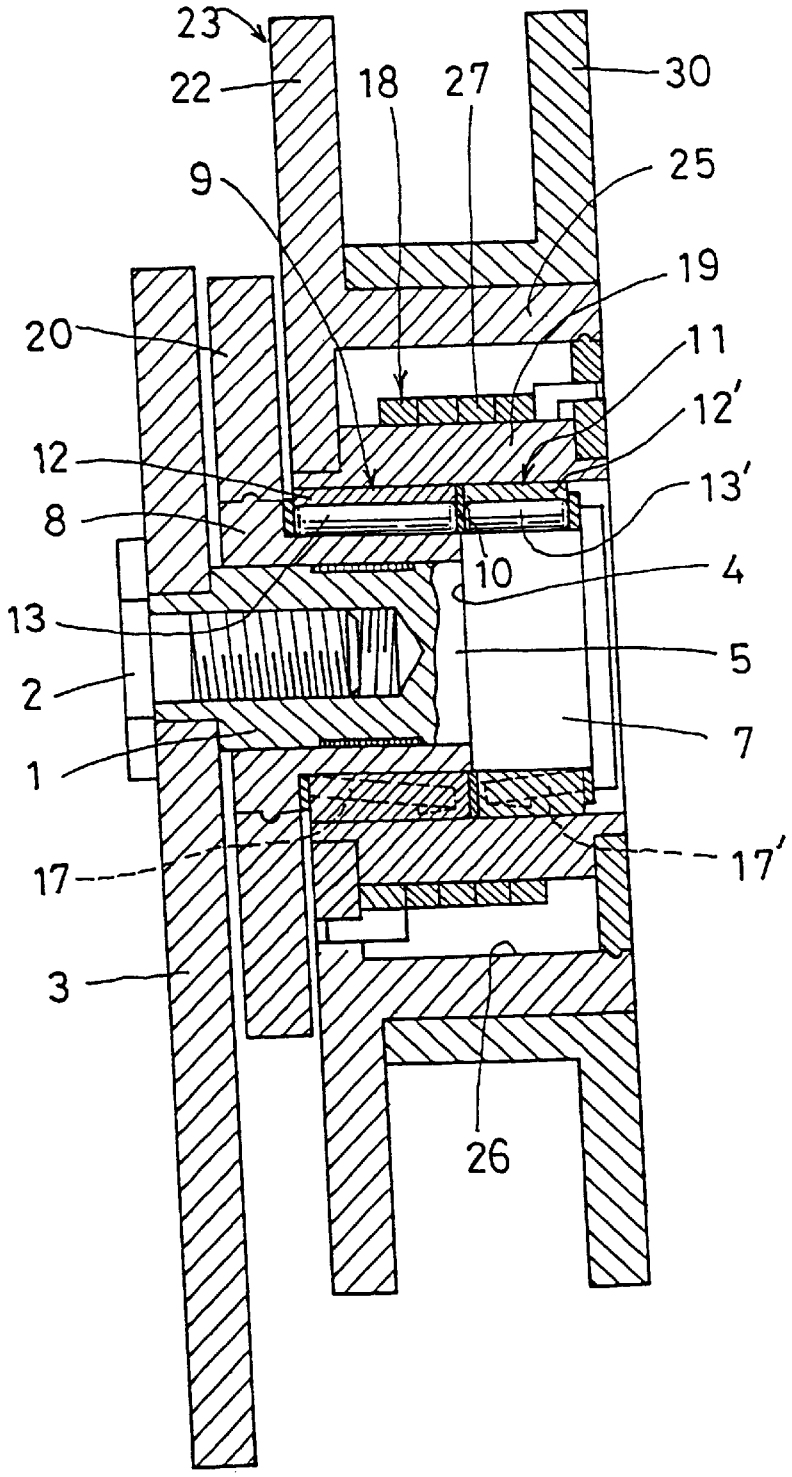
FIG. 6 is a sectional view of a third embodiment.

In the third embodiment shown in FIG. 6, the large-diameter portion 29 of the coil spring 27 of the torque limiter 18 in the first embodiment is omitted so as to form the coil spring 27 of the small-diameter portion 28 only. With this arrangement, although the range of adjustment or change of the torque value decreases, the structure of the coil spring 27 is simplified.

Figure 7:
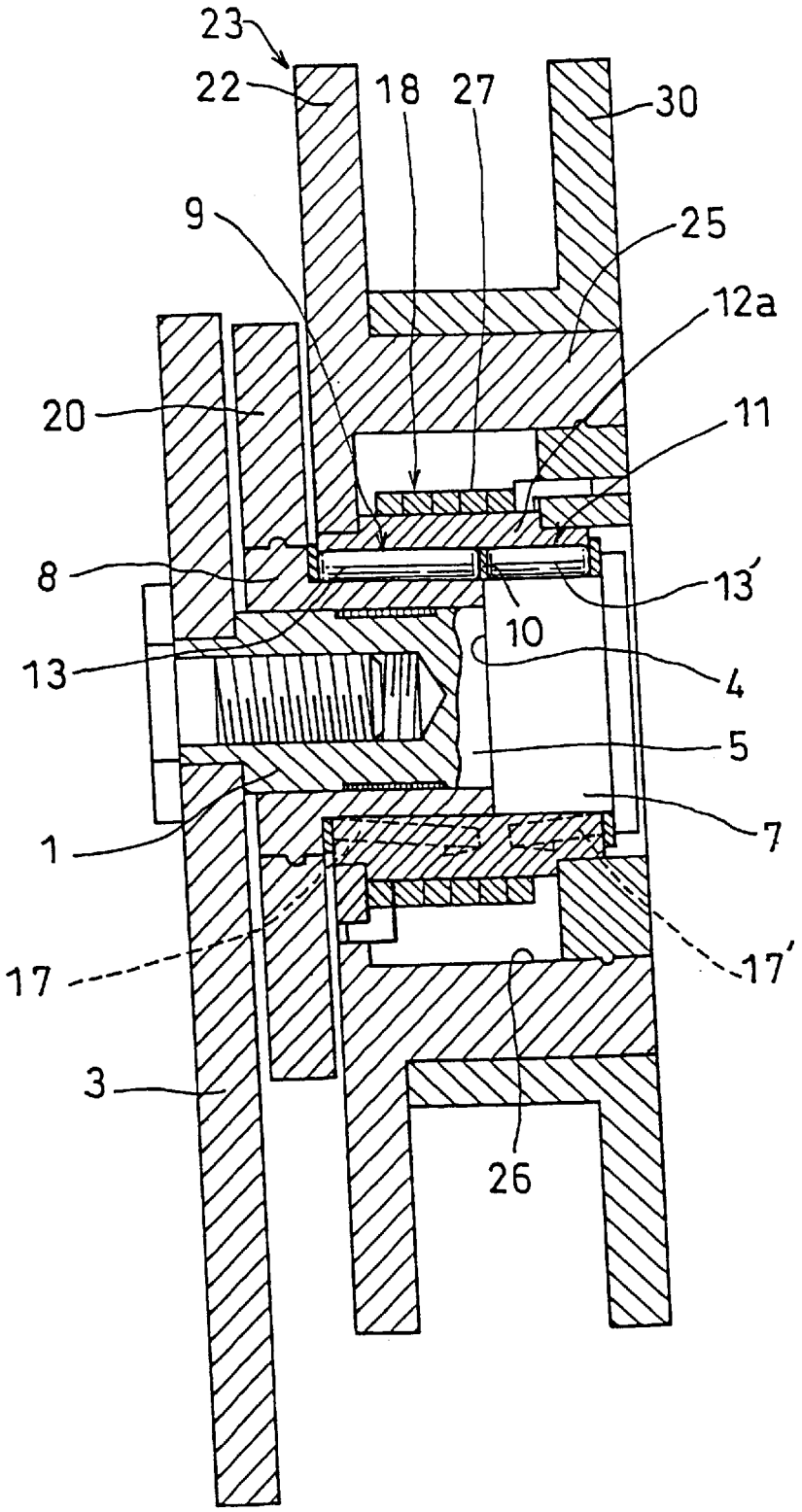
FIG. 7 is a sectional view of a fourth embodiment.

In the fourth embodiment shown in FIG. 7, as in the second embodiment, the integrated outer ring 12*a* is employed, and a coil spring 27 having only the small-diameter portion as in the third embodiment is used.

Figure 8:
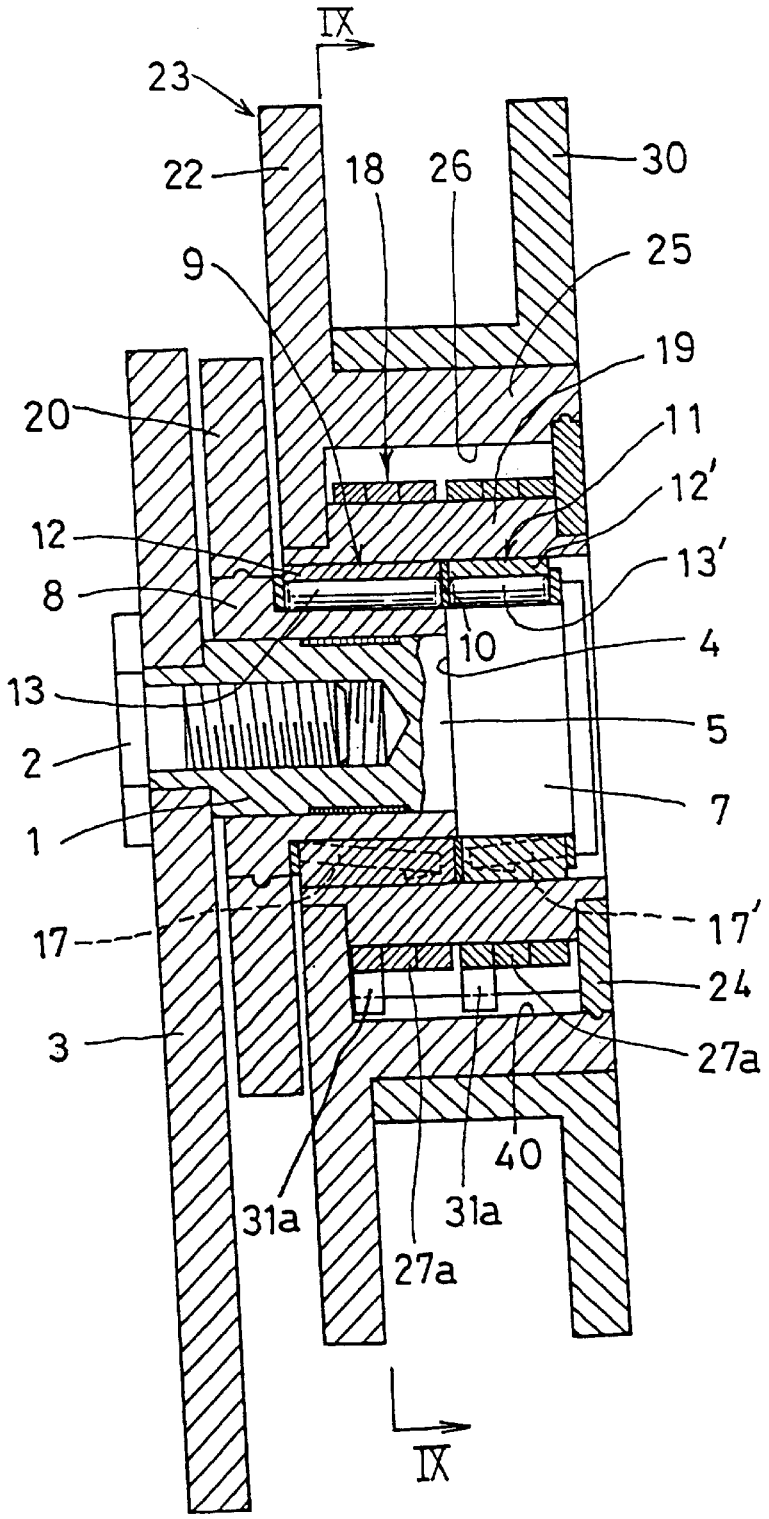
FIG. 8 is a sectional view of a fifth embodiment.

In the fifth embodiment shown in FIG. 8, instead of the coil spring 27 of the third embodiment (FIG. 6), a plurality of (two in this embodiment) coil springs 27*a* are arranged axially on the outer peripheral surface of the torque limiter ring 19. Each coil spring 27*a* has a hook 31*a* diametrically outwardly protruding from a portion corresponding to the small-diameter portion 28 in the first embodiment and engaged in a groove 40 formed axially in the inner surface of the reel boss portion 25. With this arrangement, the torque value can be set to a value twice the value of that of the arrangement with a single coil spring 27*a*.

Figure 9:
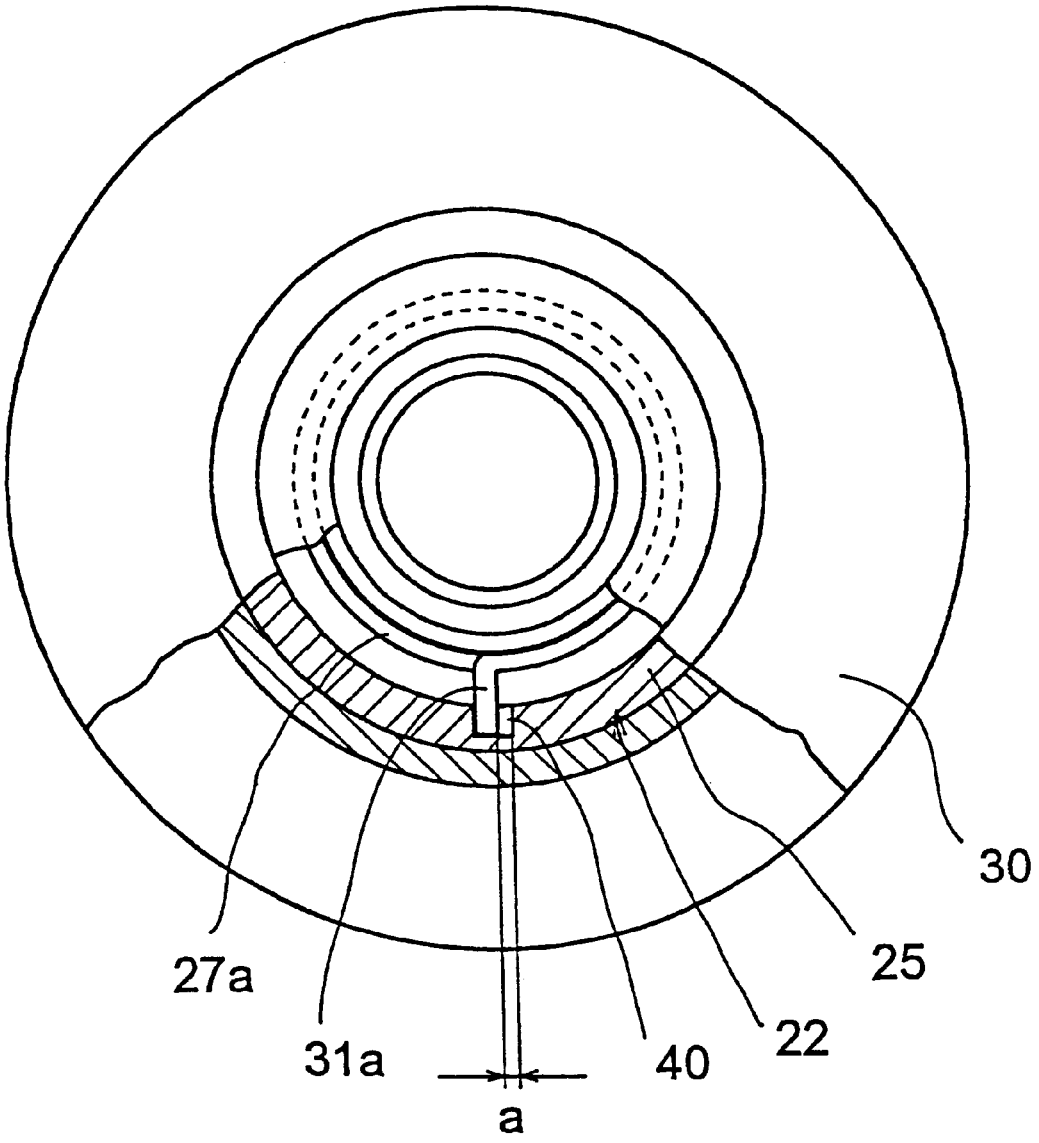
FIG. 9 is a sectional view along line IX—IX of FIG. 8.

Near the hooks 31*a* of the coil springs 27*a* in the groove 40, as shown in FIG. 9, there exist a slight gap a in the circumferential direction for easy insertion of the hooks 31*a*. But with these gaps, when the cover tape 39 is wound around the reel 30 by driving the pivoting lever 20, the coil springs 27*a* will move in the circumferential direction within the range of the gaps a, so that there appears a delay in the rotation of the reel 23 in response to the pivoting of the pivoting lever 20. This results in an insufficient rotation of the reel 23. In order to prevent this, it is possible to restrain the coil springs 27*a* by taking one of the following measures.

Figure 10A:
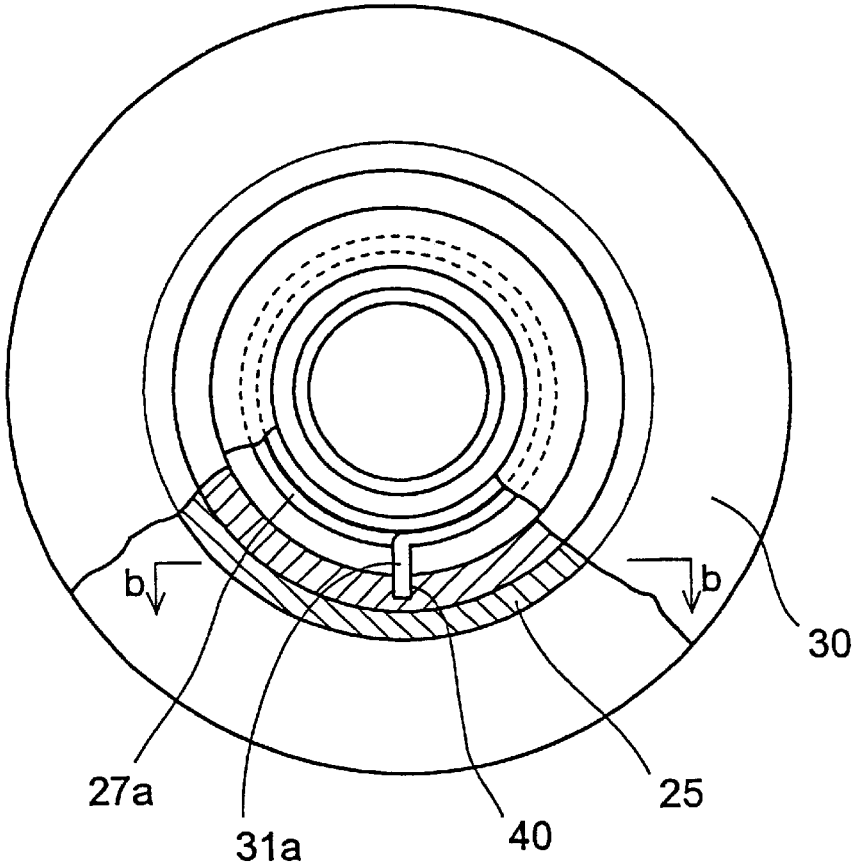
FIG. 10A is a sectional view of a modified example of the fifth embodiment.
Figure 10B:
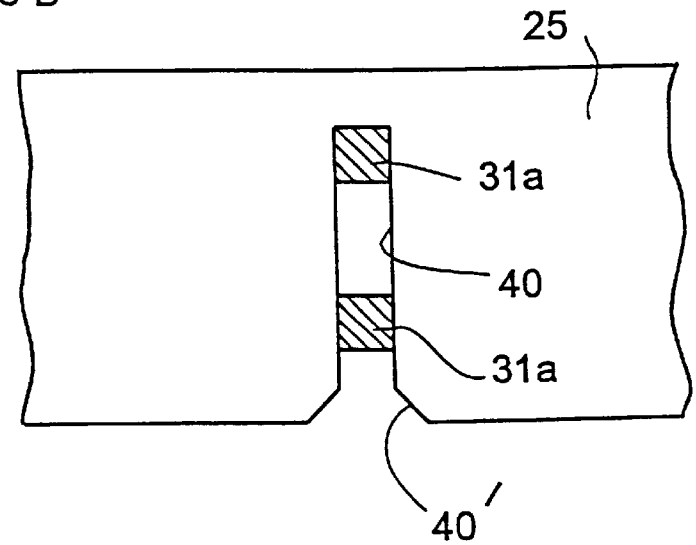
FIG. 10B is an enlarged sectional view along line b—b of FIG. 10A.

The first of the measures is, as shown in FIG. 10A, to eliminate the gaps in the groove 40 by pressing the hooks 31*a* into the groove 40. In this case, as shown in FIG. 10B, a guide surface 40' by chamfering is formed at the open end of the groove 40 so that they can be easily mounted.

Figure 11:
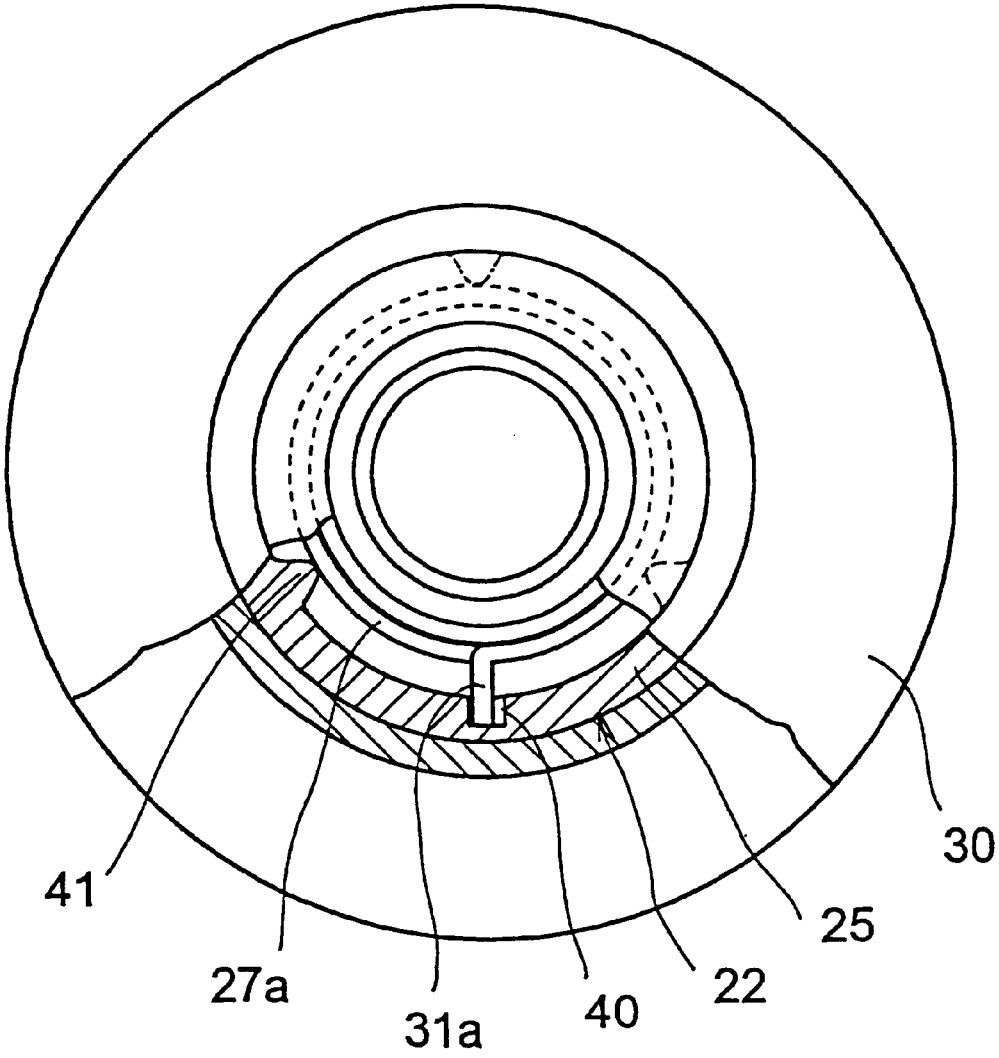
FIG. 11 is a sectional view of another modified example of the same.

The second of the measures is, as shown in FIG. 11, to provide protrusions 41 on the inner surface of the boss portion 25 of the support reel 22 at three circumferentially spaced locations and bring the outer peripheral surfaces of the coil springs 27*a* into contact with the protrusions 41 to restrain the coil springs 27*a* from their outer peripheral side by friction. Besides this structure or separately from it, one of the coil springs 27*a* may be brought into contact with the inner end of the support reel 22 and the other coil spring 27*a* may be brought into contact with the lid member 24 (not shown).

Figure 12A:
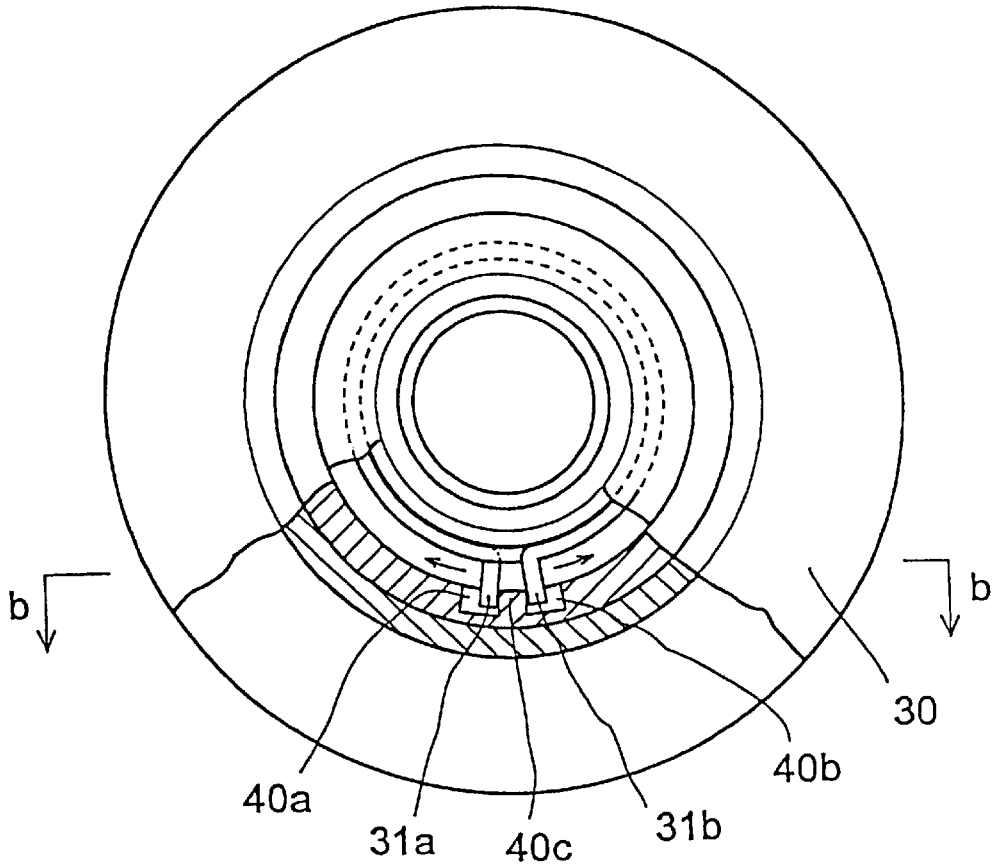
FIG. 12A is a sectional view of still another modified example of the same.
Figure 12B:
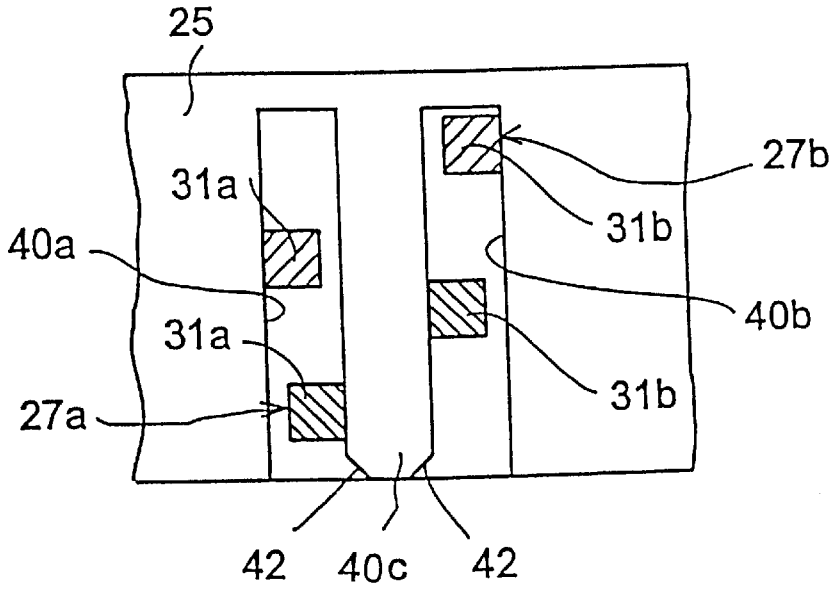
FIG. 12B is an enlarged sectional view along line b—b of FIG. 12A.

The third of the measures is, as shown in FIG. 12, to provide hooks 31*a* and 31*b* at both ends of each coil spring 27*a*, and finish the coil spring so that the hooks are close to each other. Two grooves 40*a* and 40*b* are formed in the inner surface of the boss portion 25 of the support reel 22. A rib 40*c* is formed between the grooves 40*a* and 40*b*. The distance between the hooks 31*a* and 31*b* is formed to be smaller than the width of the rib 40*c*. By pushing apart the hooks 31*a* and 31*b* to both sides (see arrow of FIG. 12A), they are brought into engagement with both sides of the rib 40*c* with a predetermined spring force. Thus, each coil spring 27*a* is restrained.

Both corners at the end of the rib 40*c* are chamfered to form guide surfaces 42.

Figure 13:
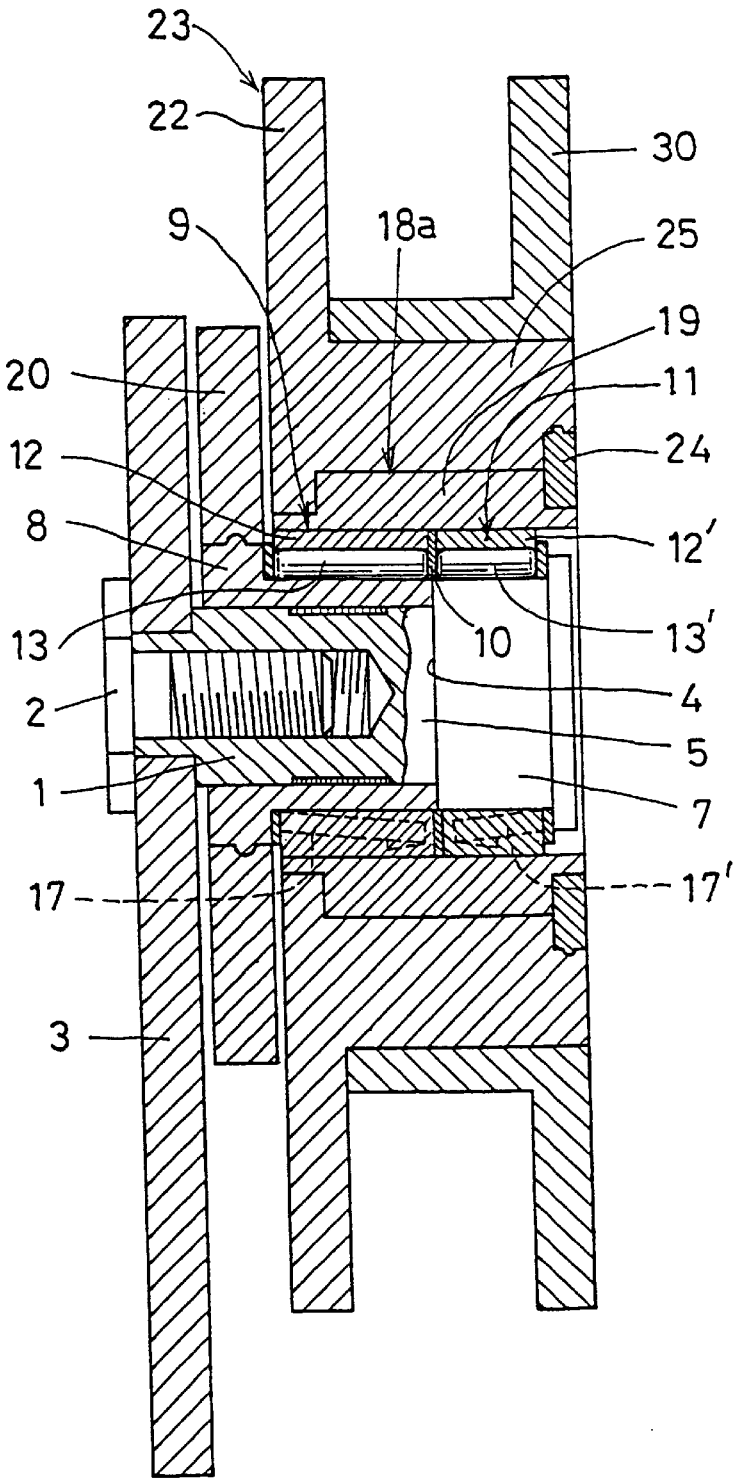
FIG. 13 is a sectional view of a sixth embodiment.

Next, in the sixth embodiment shown in FIG. 13, instead of the spring type torque limiter 18 in the first embodiment, a press-in type torque limiter 18*a* is used. A torque limiter ring 19 is pressed into the inner peripheral surface of the boss portion 25 of the support reel 22. The torque limiter ring 19 is prevented from coming out by a lid member 24 provided at the end of the boss portion 25.

The torque values in the winding and unwinding directions of the press-in type torque limiter 18*a* are identical to each other but set larger than the winding torque of the reel 23 so as not to cause a slip during winding. Also, they are set at a torque value greater than the torque in the unwinding direction by the tension in the cover tape 39 during the rest period of intermittent winding.

Thus, in order to release the tension in the cover tape 39, a torque larger than the torque in the unwinding direction is applied to the reel 23 in the unwinding direction.

Figure 14:
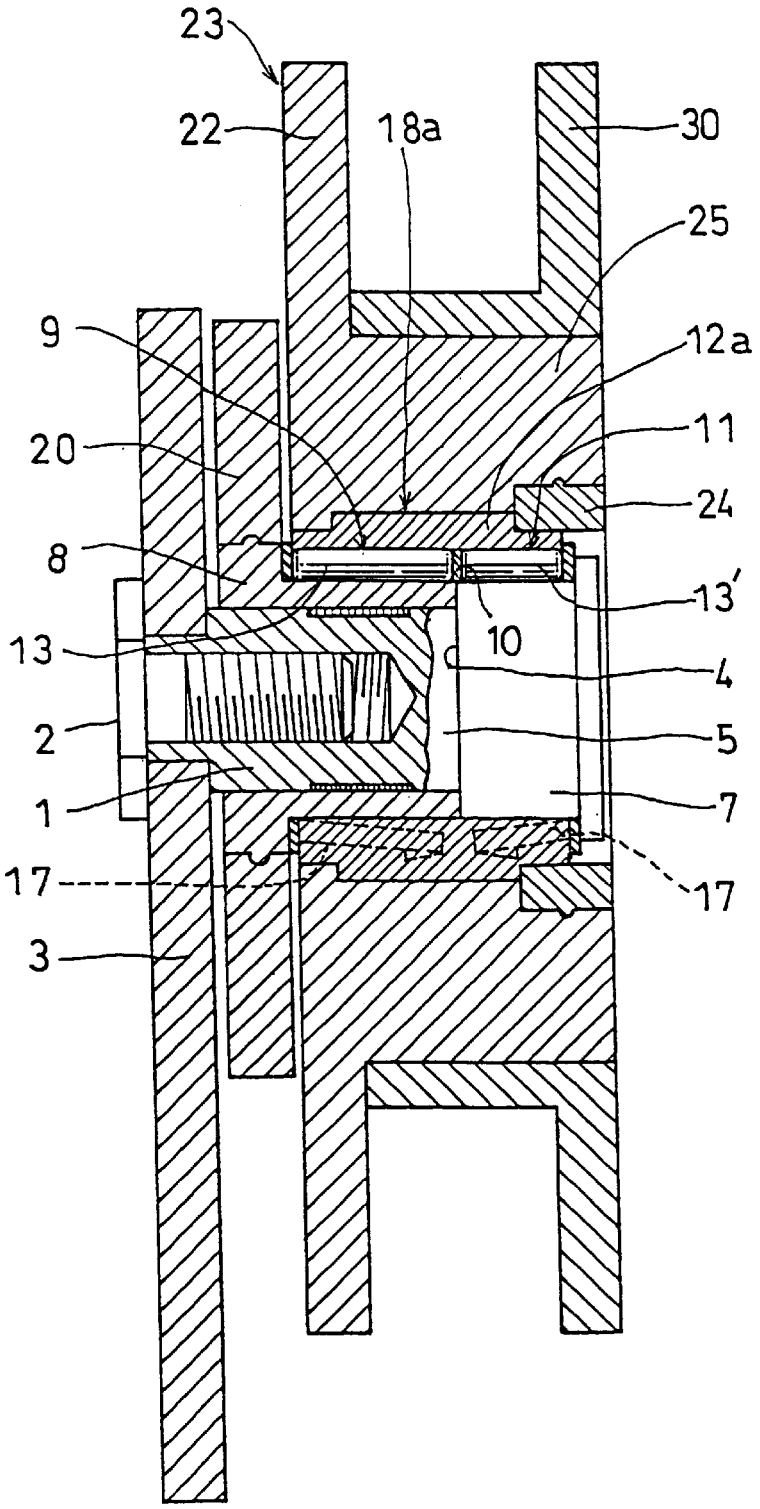
FIG. 14 is a sectional view of a seventh embodiment.

In the seventh embodiment shown in FIG. 14, the integrated outer ring 12*a* used in the fifth embodiment is used.

Figure 15:
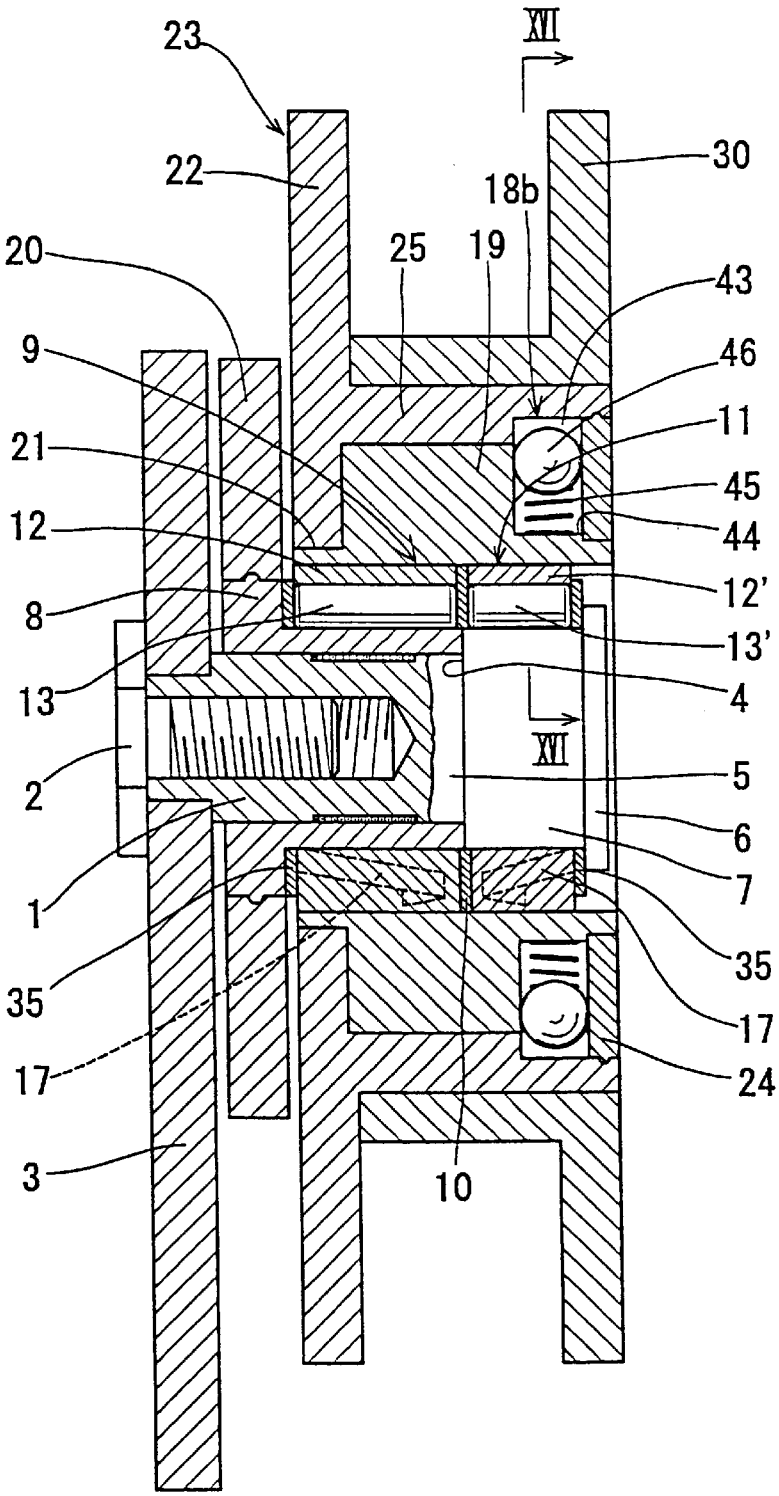
FIG. 15 is a sectional view of an eighth embodiment.

In the eighth embodiment, shown in FIGS. 15 and 16, instead of the spring type torque limiter 18 in the first embodiment, or instead of the press-in type torque limiter 18*a* of the sixth embodiment, a cam type torque limiter 18*b* is used.

Figure 16A:
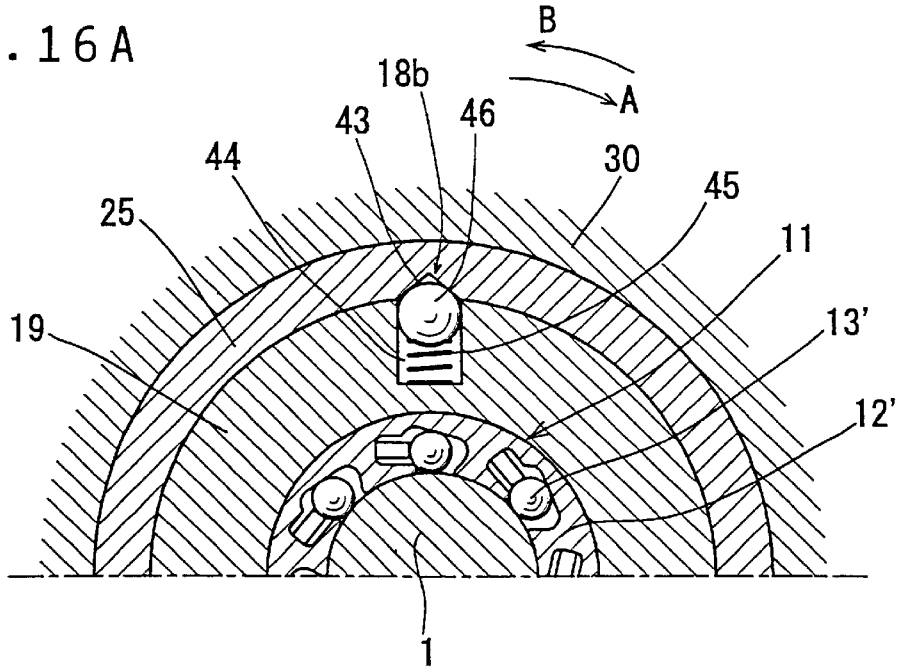
FIG. 16A is a sectional view taken along line XVI—XVI of FIG. 15.

The cam type torque limiter 18*b* is provided with cam recesses 43 having a conical section at two diametrically symmetrical locations on the inner peripheral surface of the boss portion 25 of the support reel 22 (FIG. 16A). Opposite to them, pockets 44 are formed at two symmetrical locations in the outer surface of the torque limiter ring 19. Resilient members 45 comprising coil springs, and rolling elements 46 such as balls, supported by the resilient members 45, are received in the pockets 44. In a normal state, the rolling elements 46 partially fit in the cam recesses 43, biased by the resilient members 45. The cam recesses 43 and the pockets 44 are closed by a lid member 24.

With this cam type torque limiter 18*b,* the torque values in the winding direction A and the unwinding direction B are identical, but their magnitudes are set to be larger than the winding torque of the reel 23 so that by suitably selecting the resilience of the resilient members 45, and the depth and tapering angle of the cam recesses 43, slip will not occur during winding. Also, during a rest period in intermittent winding, they are set at a torque value greater than the torque in the unwinding direction, which is the tension in the cover tape 39.

Figure 16B:
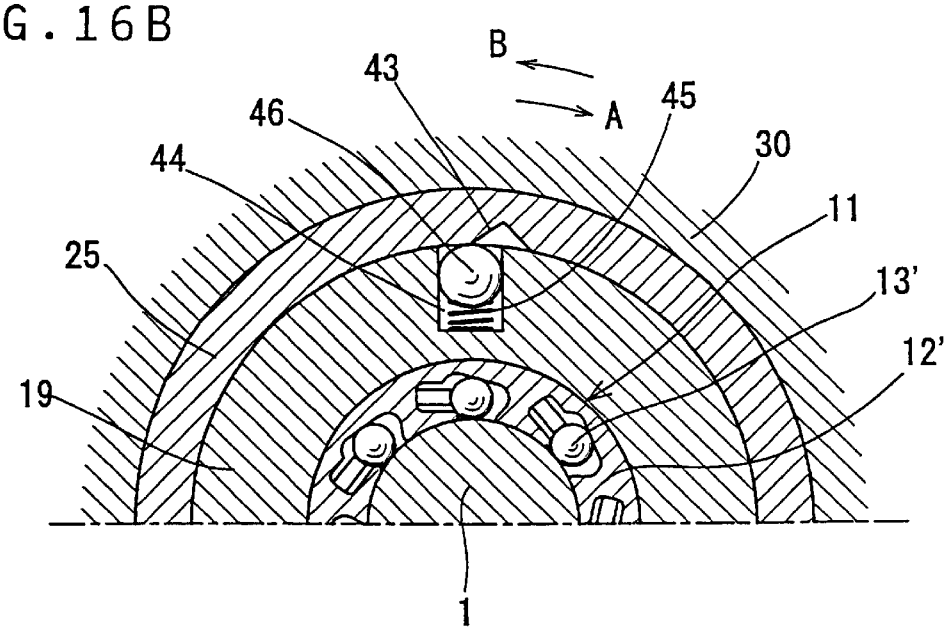
FIG. 16B is a similar view for explaining the operation.

Thus, the tension in the cover tape 39 is released by applying a torque larger than the torque in the unwinding direction to the reel 23 in the unwinding direction B, and the rolling elements 46 will move out of the cam recesses 43 as shown in FIG. 16B, so that idling occurs. Thus, tension in the cover tape 39 is released.

Figure 17A:
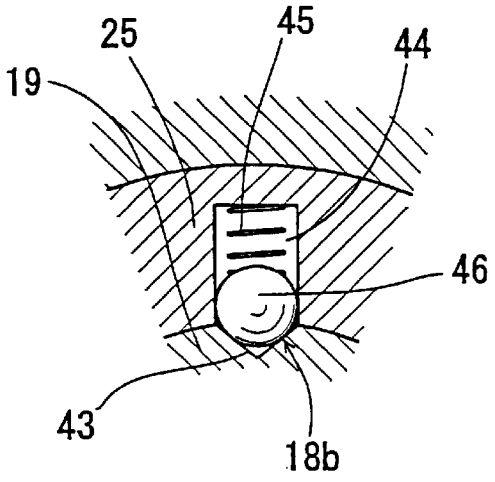
FIGS. 17A to 17C are partial sectional views showing modifications of the eighth embodiment.
Figure 17B:
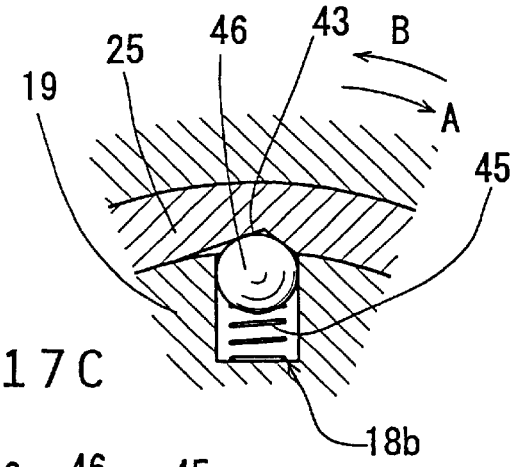

In reverse to the above, the cam recesses 43 may be formed in the torque limiter ring 19, with the pockets 44 formed in the boss portion 25 (FIG. 17A). Also, as shown in FIG. 17B, the shapes of the cam recesses 43 may be formed asymmetrically so that the inclination angle on the side of the unwinding direction B is small and the angle on the side of the winding direction A is large, and escape torque of the rolling elements 46 during winding is large, so that the escape torque during unwinding can be made smaller than that.

Figure 17C:
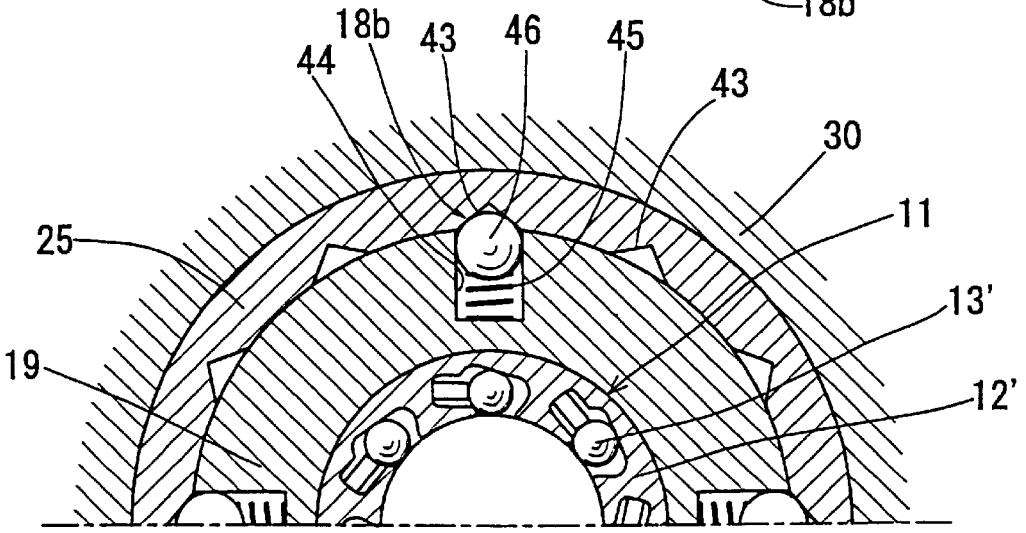

Further, as shown in FIG. 17C, the cam recesses 43 may be provided at intervals of 30° in the circumferential direction, and the pockets 44 may be provided at intervals of 90° so that the former is larger in number than the latter.

The use of the cam-type torque limiter 18*b* provides a stable support of the support reel 22 in an axial direction because the boss portion 25 of the support reel 22 is fitted on the torque limiter ring 19 over its entire axial length. This minimizes axial runout of the reel 23 and increases the winding accuracy.

Figure 18A:
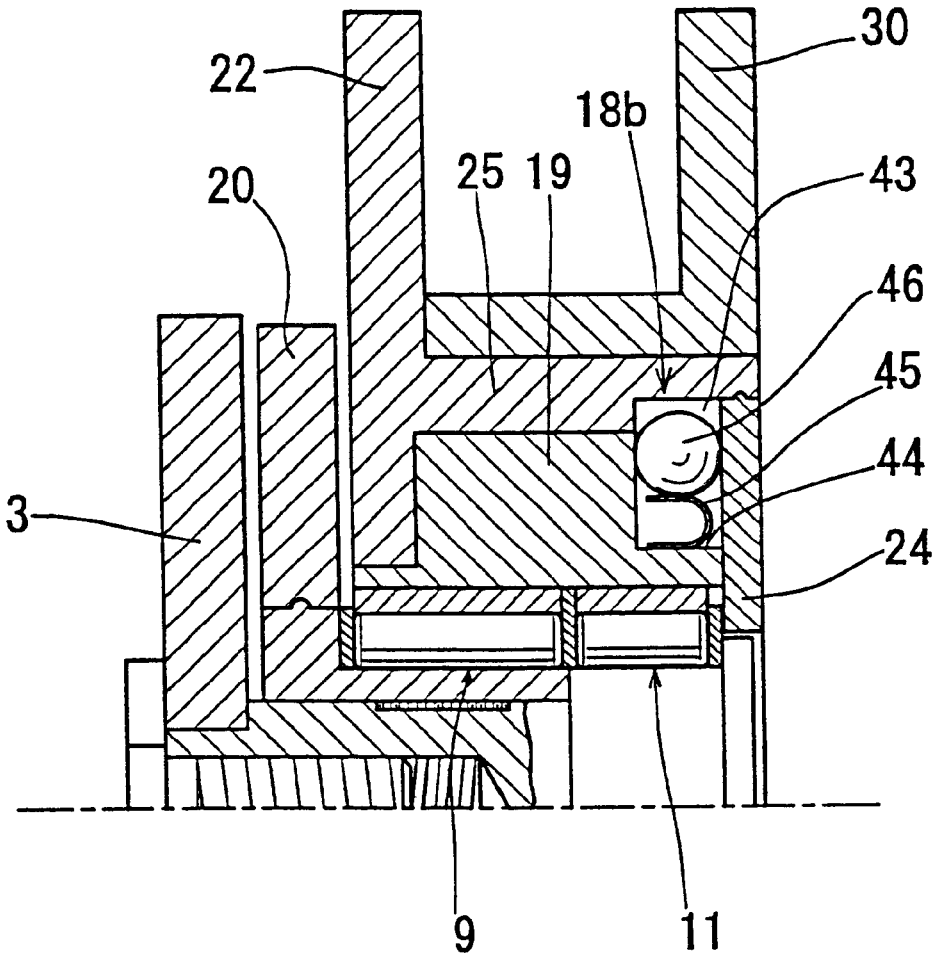
FIGS. 18A to 18C are partial sectional views showing modified examples of a resilient member.
Figure 18B:
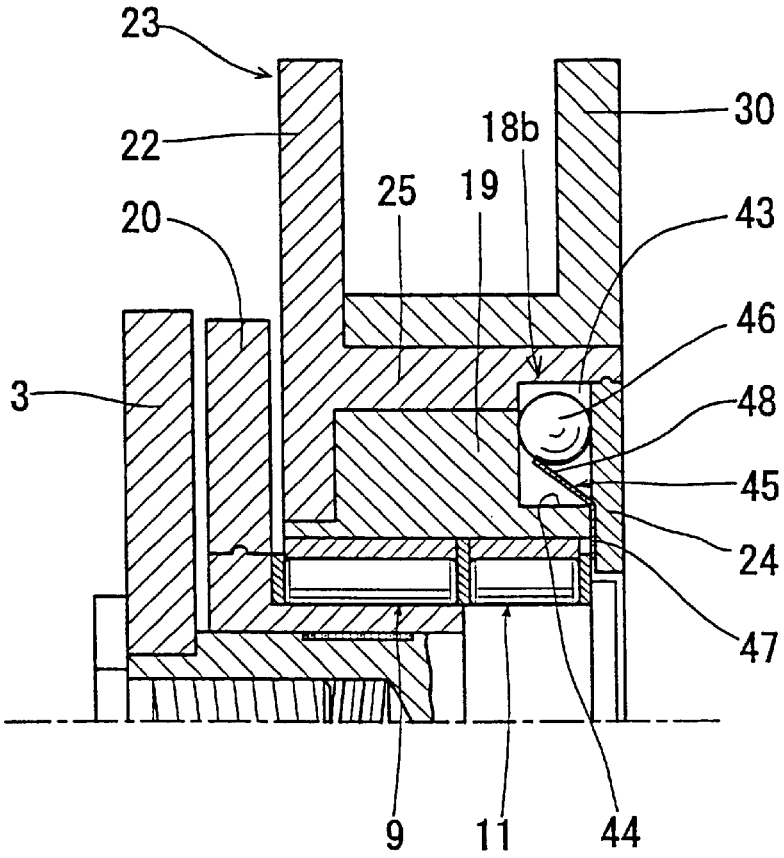
Figure 18C:
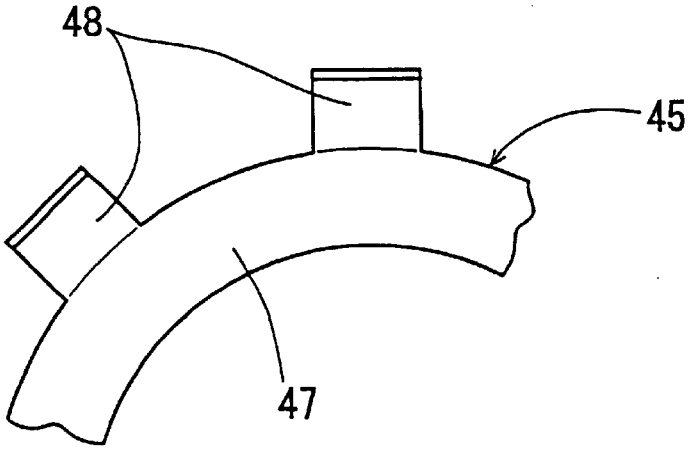

As a modified example of the resilient members 45, U-shaped leaf springs may be used as shown in FIG. 18A. Also, as shown in FIGS. 18B and 18C, as the resilient members 45, ones may be used in which spring pieces 48 protrude outwardly from an annular plate member 47. The annular plate member 47 is sandwiched between the end face of the torque limiter ring 19 and the lid member 24 with the spring pieces 48 bent into the pockets 44 to support the rolling elements 46.

Figure 19A:
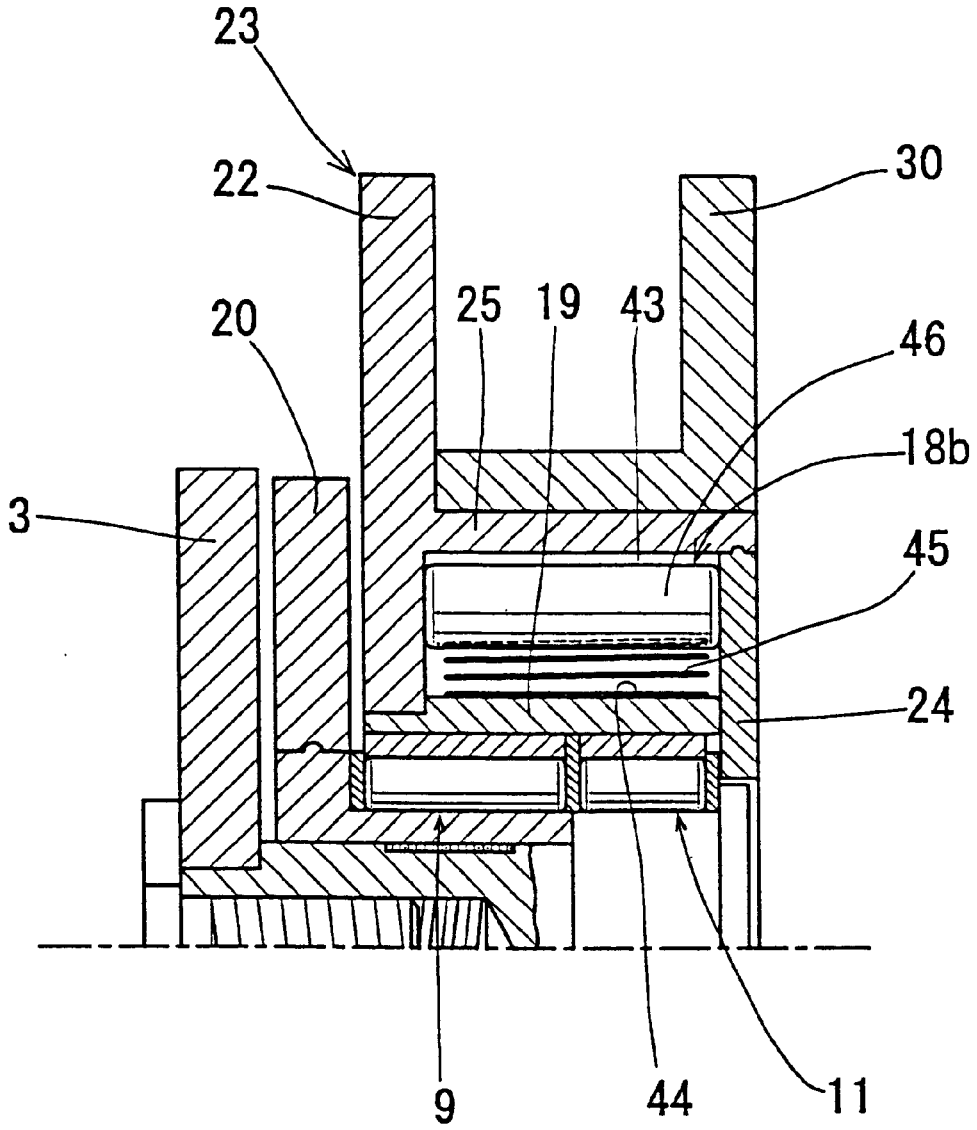
FIGS. 19A to 19C are partial sectional views showing modified examples of rolling elements.
Figure 19B:
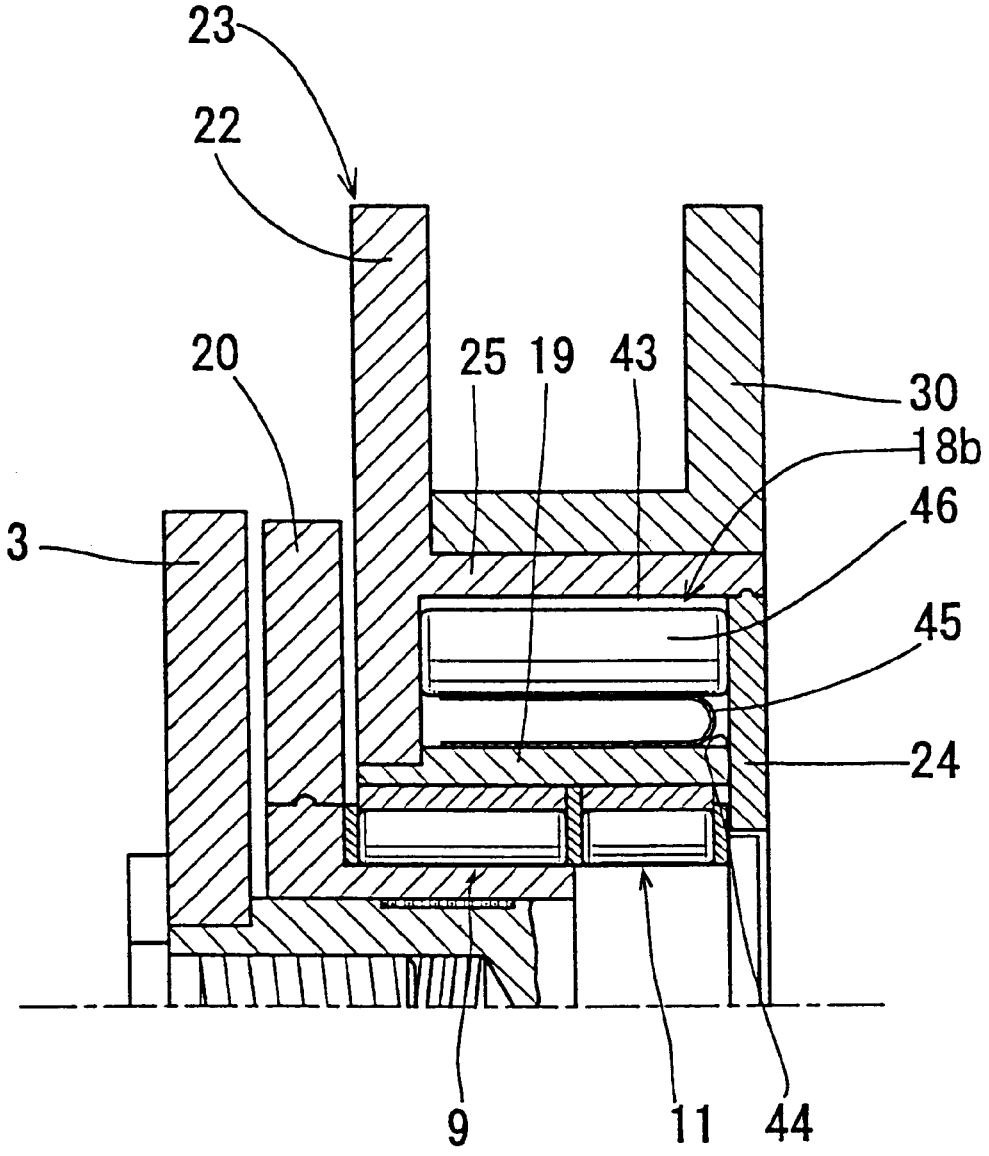
Figure 19C:
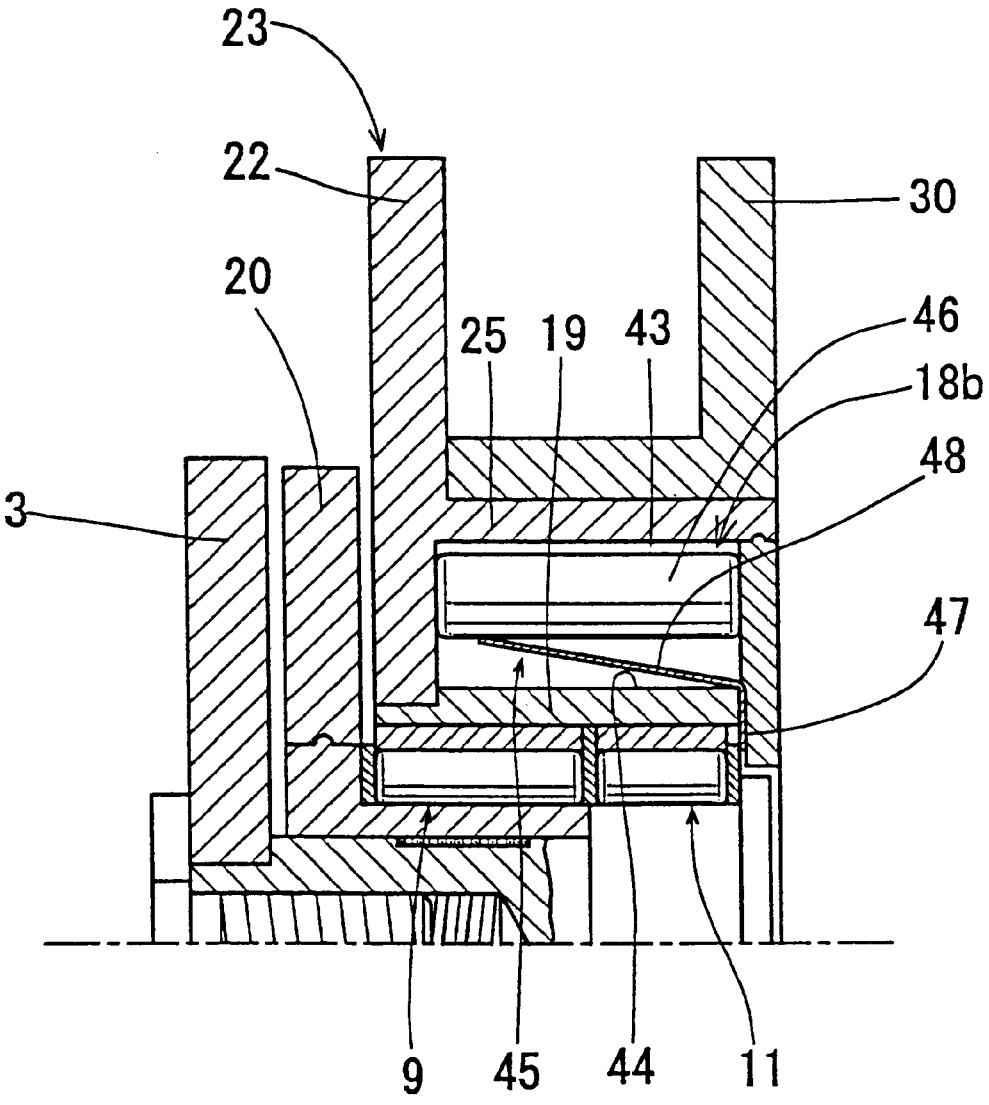

In the modified examples shown in FIGS. 19A, 19B and 19C, as the rolling elements 46, rollers are used. As the resilient members 45, coil springs (FIG. 19A), U-shaped leaf springs (FIG. 19B), or the annular plate member 47 with the spring pieces 48 (FIG. 19C) may be used.

Figure 20A:
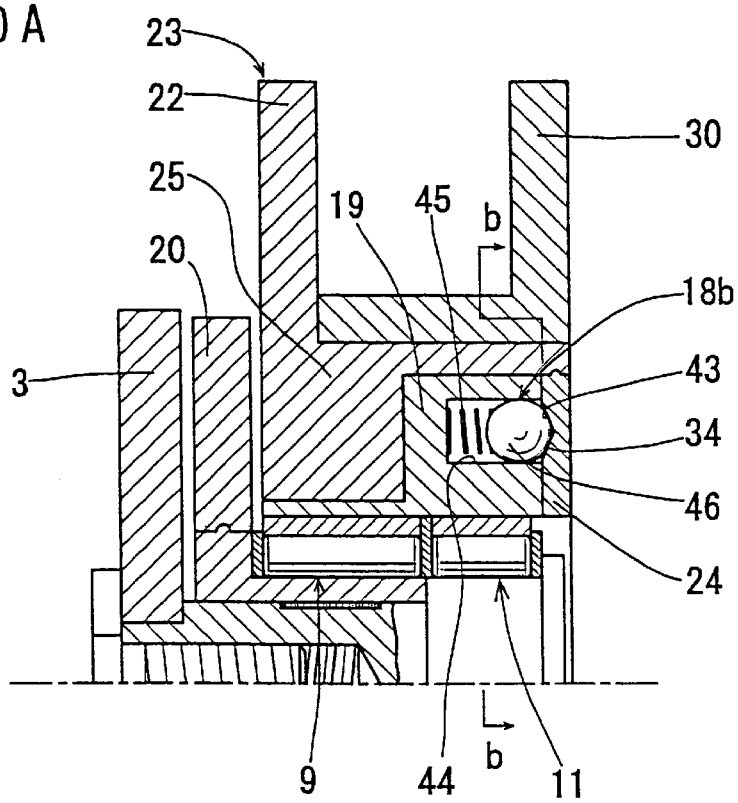
FIG. 20A is a sectional view of a ninth embodiment.
Figure 20B:
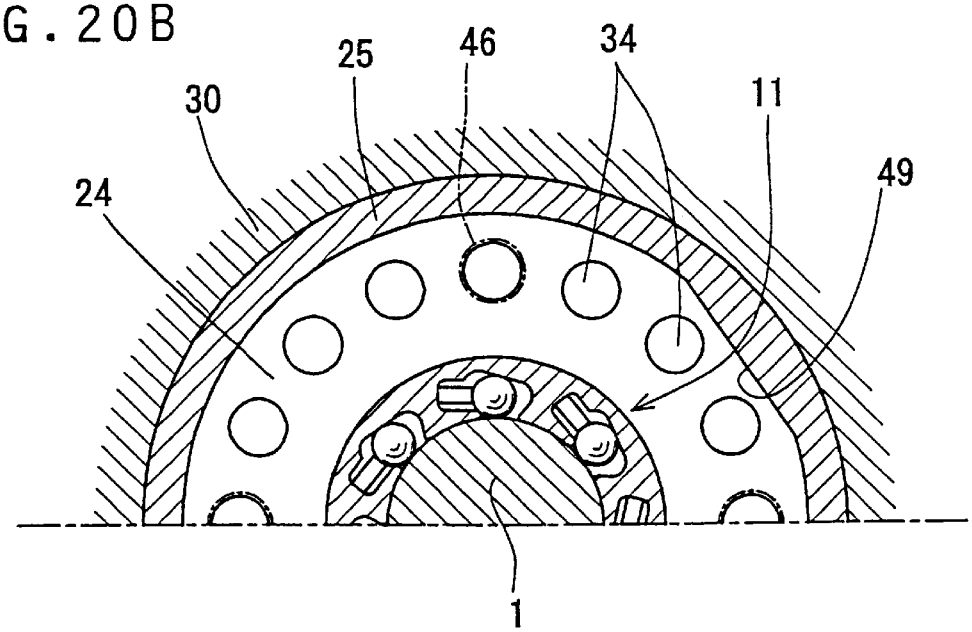
FIG. 20B is a sectional view taken along line b—b of FIG. 20A.

Also, in the ninth embodiment, shown in FIGS. 20A and 20B, cam recesses 34 are formed in the inner surface of the lid member 24 at predetermined angular intervals, and pockets 44 smaller in number than the cam recesses 34 are formed in the end face of the torque limiter ring 19 opposing the lid member 24. Also, resilient members 45 comprising coil springs and rolling elements 46 are housed in the pockets 44 with the rolling elements 46 biased toward the cam recesses 34. A D-shaped cutout 49 is formed in the lid member 24 to prevent it from turning relative to the reel boss portion 25. By the cutout 49, the lid member 24 is integrated with the reel boss portion 25. In this embodiment, too, as the resilient members 45, U-shaped springs may be used.

Figure 21:
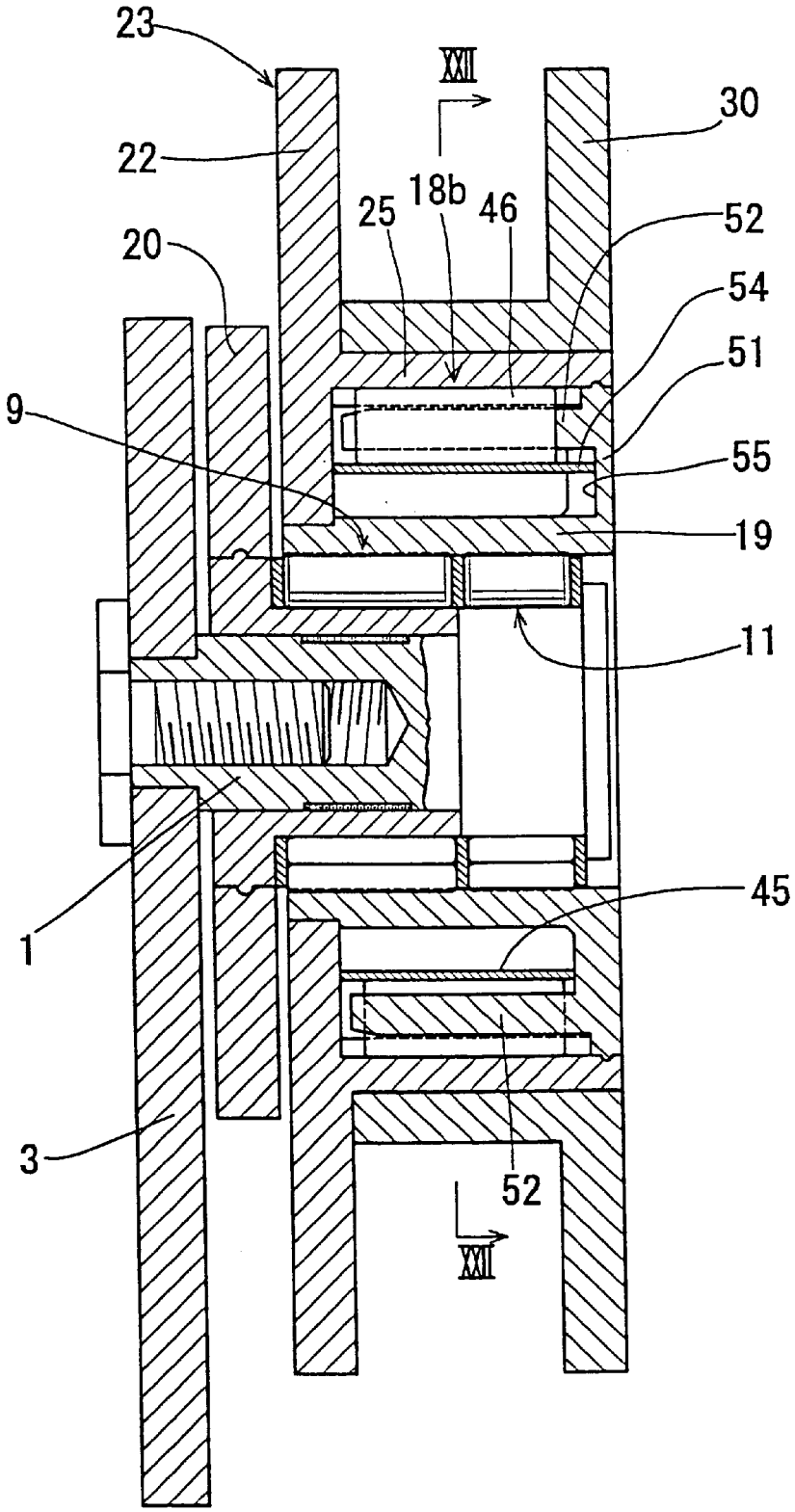
FIG. 21 is a sectional view of a tenth embodiment.
Figure 22:
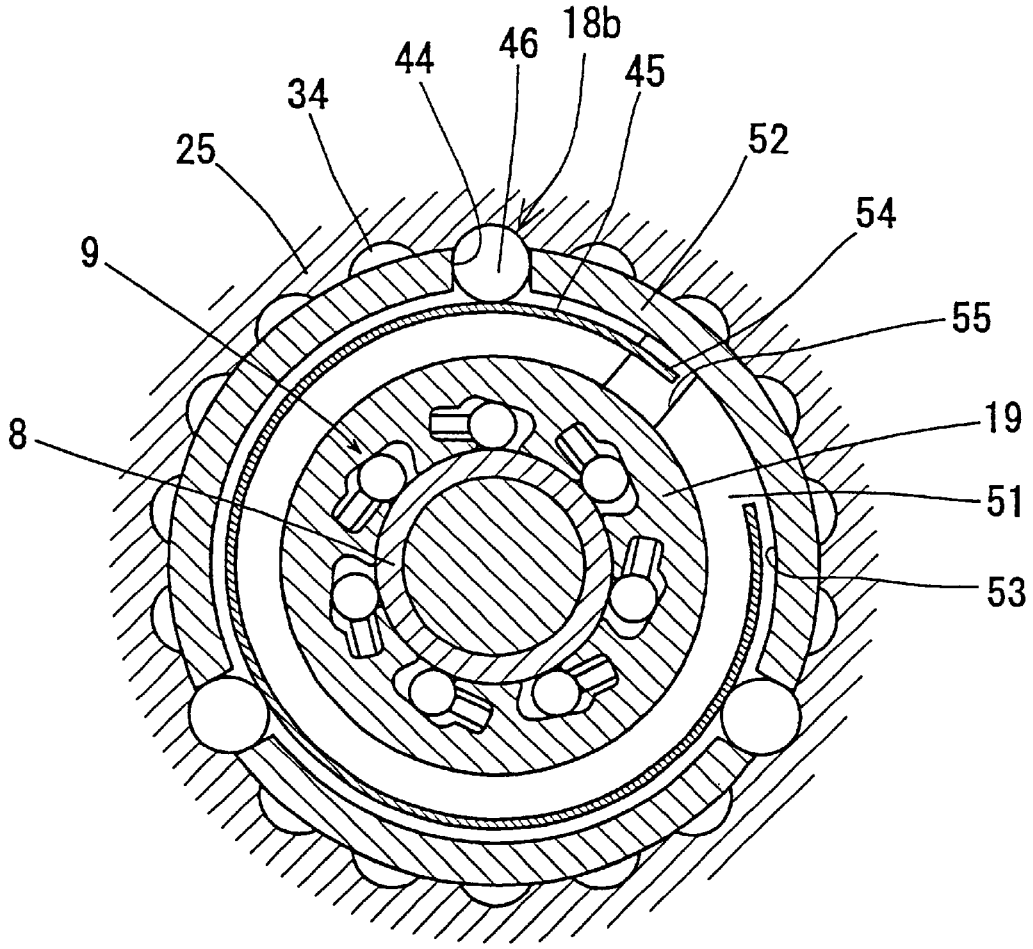
FIG. 22 is a sectional view taken along line XXII—XXII of FIG. 21.
Figure 23:
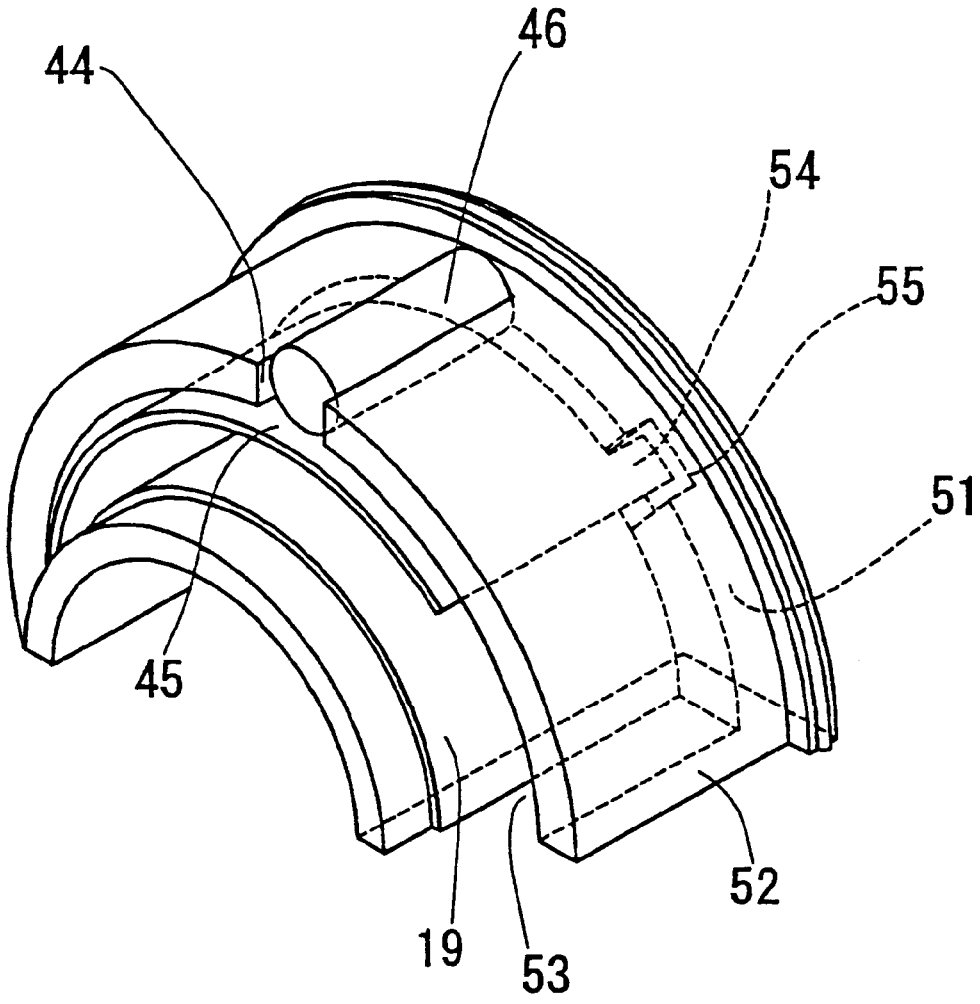
FIG. 23 is a perspective view of the tenth embodiment.
Figure 24:
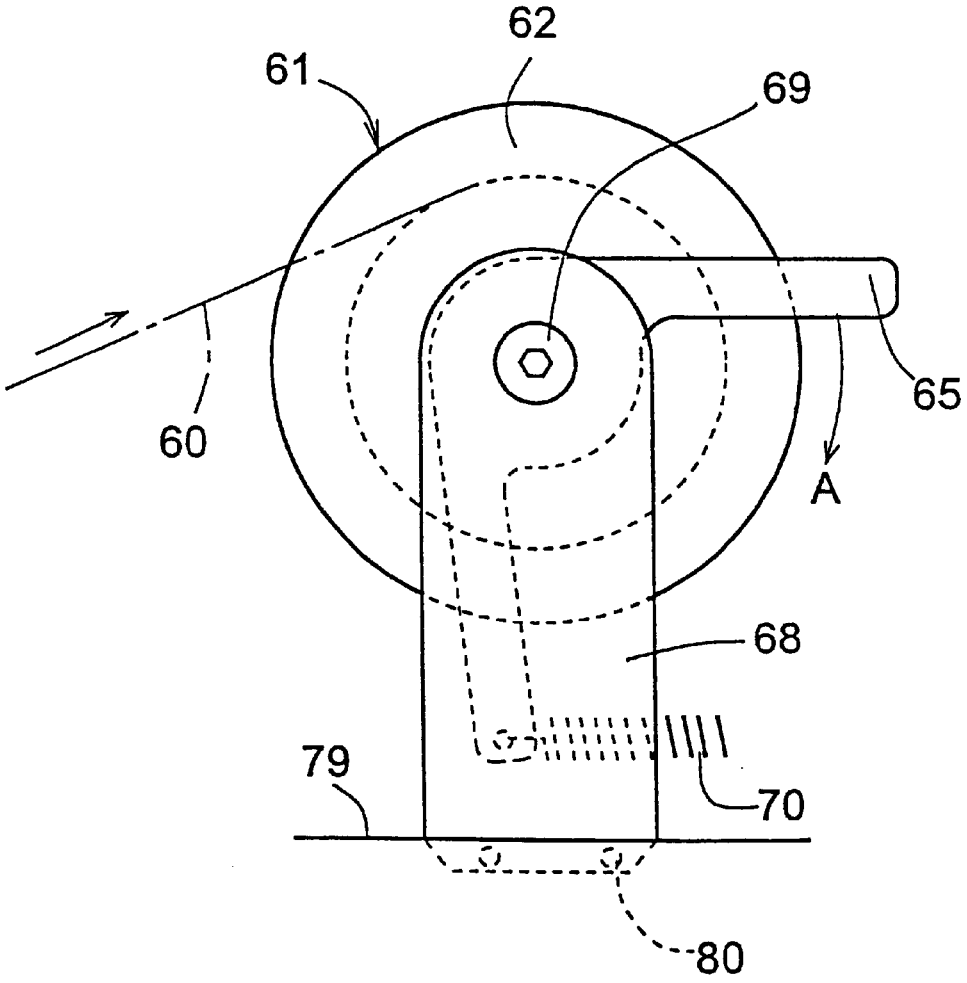
FIG. 24 PRIOR ART
FIG. 24 is a front view of a conventional unit in use.
Figure 25:
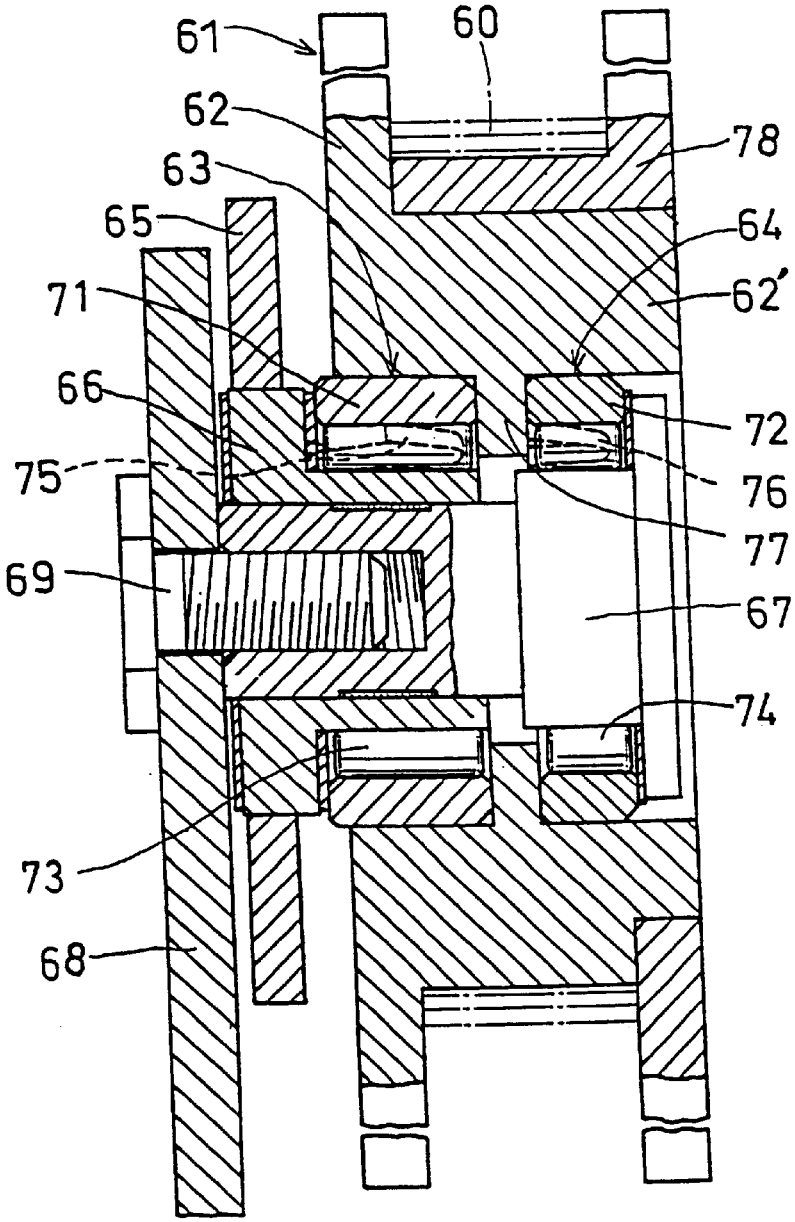
FIG. 25 PRIOR ART
FIG. 25 is a vertical sectional side view of the same.

In any of the above embodiments using the cam type torque limiter 18*b,* the resilient members 45 are entirely or partially received in the pockets 44. But in the 10th embodiment shown in FIGS. 21–23, while the rolling elements 46 are housed in the respective pockets 44, the resilient members 45 are formed of a single part housed in a resilient member housing portion 53 inside of a rolling element retaining portion 52. That is to say, the torque limiter ring 19 has, as shown in FIG. 21, a closure portion 51 corresponding to the lid member 24 in the above embodiments at one end, and further a tubular rolling element retaining portion 52 extending inwardly from the closure portion 51 (FIG. 23). The rolling elements 46 are rollers, and pockets 44 for receiving them are provided at three locations of the rolling element retaining portion 52 (FIG. 22).

Between the torque limiter ring 19 and the rolling element retaining portion 52, a resilient member housing portion 53 is formed. A resilient member 45, housed in the resilient member housing portion 53, is formed by bending a metallic plate into a C shape and providing a protrusion 54 at one end thereof. By engaging the protrusion 54 in a recess 55 formed in the inner surface of the closure portion 51, turning of the resilient member 45 in the circumferential direction is prevented while permitting its resilient deformation in radial directions. The resilient member 45 is arranged along the inside of the pockets 44 at three locations and imparts an outward biasing force to the rolling elements 46 in abutment with them. As with the above-said embodiments, the rolling elements 46 partially fit in cam recesses 34 formed in the reel boss portion 25 with a predetermined biasing force. Other structures and functions are the same as in the other embodiments.

As described above, according to this invention, in a winding unit for a web, during replacement of a reel, by forcibly pivoting the reel or the reel body integral therewith in the unwinding direction with a torque greater than a predetermined value, the tension in the web wound around the reel can be released to impart a desired slack. Thus, replacement of the reel becomes easy.

What is claimed is:

1. A winding unit for winding a web, said winding unit comprising a fixed shaft, a rotary sleeve having a lever and rotatably mounted on said fixed shaft, a support reel having a reel boss portion, a reel detachably mounted on said reel boss portion, a one-way clutch for driving and a one-way clutch for braking each having an outer ring formed with a plurality of circumferentially inclined cam surfaces on an inner peripheral surface thereof, rolling elements mounted at positions opposing said cam surfaces, respectively, and springs for biasing said rolling elements in such directions as to be locked by said cam surfaces, said one-way clutches being mounted in said reel boss portion, said one-way clutch for driving being mounted on said fixed shaft through said rotary sleeve, said one-way clutch for braking being mounted on said fixed shaft, said reel being intermittently rotated by pivoting said pivoting lever to wind the web on said reel, a torque limiter being provided between said outer ring and said reel boss portion to shut off transmission to said outer ring of a turning torque in the unwinding direction applied to said reel boss portion.

2. The winding unit as claimed in claim 1 wherein said torque limiter is set so as to have a sufficiently large winding torque value for the transmission of a torque in the winding direction from said outer ring to said reel boss portion and to have a predetermined unwinding torque value for the transmission of a torque in the unwinding direction from said reel boss portion to said outer ring.

3. The winding unit as claimed in claim 1 wherein said torque limiter is a spring type torque limiter comprising a torque limiter ring mounted on an outer peripheral surface of said outer ring, and a coil spring mounted on an outer peripheral surface of said torque limiter ring with a predetermined binding force, said coil spring has one end thereof engaging said reel boss portion, said coil spring being adapted to lock when the torque limiter ring rotates in the winding direction so that the binding force increases, and to have a predetermined unwinding torque value when said reel boss portion rotates in the unwinding direction so that the binding force decreases.

4. The winding unit as claimed in claim 1 wherein a restraining means for said coil spring is provided on said reel boss portion to prevent said one end of said coil spring from moving in the circumferential direction.

5. The winding unit as claimed in claim 3 wherein said coil spring has the other end thereof engaging a lid member fitted in the end of said torque limiter ring.

6. The winding unit as claimed in claim 1 wherein said torque limiter is a press-in type torque limiter comprising a torque limiter ring pressed in said reel boss portion.

7. The winding unit as claimed in claim 1 wherein said torque limiter is a cam type torque limiter comprising a torque limiter ring pressed in said reel boss portion, cam recesses formed in one of said torque limiter ring and said reel boss portion, rolling elements housed in pockets formed in the other thereof so as to oppose said cam recesses, and resilient members each housed in said respective pockets for biasing said rolling elements toward said cam recesses.

8. The winding unit as claimed in claim 7 wherein said torque limiter ring has a rolling element retaining portion on a radially outer side thereof and a resilient member retaining portion on a radially inner side thereof, said rolling element retaining portion being formed with a plurality of pockets at angular spacings so as to radially extend therethrough, said rolling elements being housed in said respective pockets and biassed by a single resilient member housed in said resilient member retaining portion.

9. The winding unit as claimed in claim 2 wherein said torque limiter is a spring type torque limiter comprising a torque limiter ring mounted on an outer peripheral surface of said outer ring, and a coil spring mounted on an outer peripheral surface of said torque limiter ring with a predetermined binding force, said coil spring has one end thereof engaging said reel boss portion, said coil spring being adapted to lock when the torque limiter ring rotates in the winding direction so that the binding force increases, and to have a predetermined unwinding torque value when said reel boss portion rotates in the unwinding direction so that the binding force decreases.

10. The winding unit as claimed in claim 2 wherein a restraining means for said coil spring is provided on said reel boss portion to prevent said one end of said coil spring from moving in the circumferential direction.

11. The winding unit as claimed in claim 3 wherein a restraining means for said coil spring is provided on said reel boss portion to prevent said one end of said coil spring from moving in the circumferential direction.

12. The winding unit as claimed in claim 4 wherein said coil spring has the other end thereof engaging a lid member fitted in the end of said torque limiter ring.

* * * * *